US009634410B2

(12) United States Patent
Takane

(10) Patent No.: US 9,634,410 B2
(45) Date of Patent: Apr. 25, 2017

(54) CONNECTOR

(71) Applicant: IRISO ELECTRONICS CO., LTD., Kanagawa (JP)

(72) Inventor: Toru Takane, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/659,738

(22) Filed: Mar. 17, 2015

(65) Prior Publication Data

US 2015/0270632 A1 Sep. 24, 2015

(30) Foreign Application Priority Data

Mar. 20, 2014 (JP) ..... 2014-058352

(51) Int. Cl.

| | |
|---|---|
| ***H01R 12/00*** | (2006.01) |
| ***H01R 12/79*** | (2011.01) |
| ***H01R 12/77*** | (2011.01) |
| ***H01R 13/6594*** | (2011.01) |
| ***H01R 12/71*** | (2011.01) |
| *H01R 12/87* | (2011.01) |
| *H01R 13/6596* | (2011.01) |

(52) U.S. Cl.

CPC ..... *H01R 12/79* (2013.01); *H01R 12/716* (2013.01); *H01R 12/774* (2013.01); *H01R 13/6594* (2013.01); *H01R 12/87* (2013.01); *H01R 13/6596* (2013.01)

(58) Field of Classification Search

CPC ..... H01R 12/79; H01R 12/716; H01R 12/87; H01R 12/774; H01R 13/6596; H01R 13/6594

USPC ..... 439/78, 357, 358, 492, 493, 497, 499

See application file for complete search history.

(56) References Cited

U.S. PATENT DOCUMENTS

| | | | |
|---|---|---|---|
| 2006/0154508 | A1 | 7/2006 | Shimoyama |
| 2011/0189879 | A1 | 8/2011 | Okamura |

FOREIGN PATENT DOCUMENTS

| | | | |
|---|---|---|---|
| EP | 2469665 | A2 | 6/2012 |
| EP | 24930023 | A2 | 8/2012 |
| JP | 2005-347021 | A | 12/2005 |
| JP | 2008-027707 | A | 2/2008 |
| JP | 2012-199187 | A | 3/2011 |
| JP | 2011-159570 | A | 8/2011 |
| JP | 2012-043653 | A | 3/2012 |
| JP | 2013-004392 | A | 1/2013 |
| WO | WO2006/026036 | A1 | 3/2006 |

OTHER PUBLICATIONS

European Search Report for European Patent App. No. 15159182.3 (Jul. 29, 2015).

(Continued)

*Primary Examiner* — Khiem Nguyen

(74) *Attorney, Agent, or Firm* — Cermak Nakajima & McGowan LLP; Tomoko Nakajima

(57) ABSTRACT

A first space in which terminals are disposed and that is connected to a first connection and a second space in which ground terminals are disposed and that is connected to a second connection are provided in a housing portion of a flat conductor including a plate. Furthermore, in the thickness direction of the flat conductor including a plate, the second space is formed with a size that is equivalent to or greater than the thickness of a ground plate so as to enable the second connection to the housed therein.

16 Claims, 19 Drawing Sheets

(56) References Cited

OTHER PUBLICATIONS

Office Action from Japanese Patent App. No. 2014-058352 (Nov. 28, 2014).
Office Action from Japanese Patent App. No. 2014-058352 (Apr. 24, 2015).

CONNECTOR

BACKGROUND OF THE INVENTION

1. Field of the Invention

The present disclosure relates to a connector that conductively connects a flat conductor and a circuit board to each other.

2. Description of the Related Art

Hitherto, a connector used in an electronic device is mounted on a circuit board and conductively connects a flexible printed circuit (FPC), a flexible flat cable (FFC), or the like (referred to as a "flat conductor" in the present description and the claims) and a circuit board to each other. Since such a connector can connect a unit, such as a computer or a liquid crystal display, in the system and a circuit board to each other in various forms, the connector is installed in many electronic devices.

In recent years, electronic components have become highly functional and multifunctional and the amount of data transmitted has increased; accordingly, flat conductors that are capable of high-speed transmission of signals of higher frequencies are used. Accordingly, measures against electromagnetic interference (EMI) such as noise generated by the flat conductor are awaited. As an example of a flat conductor that has employed such a measure, there is a flat conductor (hereinafter, referred to as a "flat conductor including a plate" in the present description) on which a conductive member such as a ground plate grounded to the ground terminal provided in the connector is stacked, and, typically, a special connector is used for such a flat conductor (see Japanese Unexamined Patent Application Publication No. 2005-347021, for example).

SUMMARY OF THE INVENTION

Incidentally, the difference between a typical flat conductor and a flat conductor including a plate is, in many cases, whether there is a conductive member such as a ground plate stacked thereon. Accordingly, it is desirable that a single connector can be used for both a typical flat conductor and a flat conductor including a plate rather than separately using a connector for a typical flat conductor and a connector for a flat conductor including a plate since there will be various advantages on the user side and on the manufacturer side, such as reduction in manufacturing cost and elimination of the need to select an adapting connector.

One way to allow a single connector to be used for both conductors is to use a flat conductor including a plate for the typical flat conductor. The reason for the above is that a flat conductor including a plate is formed thicker than a typical flat conductor by the thickness of the conductive member; accordingly, the housing portion inside the connector that receives the flat conductor including a plate is also formed with a space that is large compared with a space of a housing portion of a connector for a typical flat conductor. However, when a typical flat conductor is fitted therein, a gap will be created between the flat conductor and an inner wall of the housing portion and the fitting state will be unstable. In such a case, the gap may be eliminated by adhering a tape to the flat conductor, for example; however, the tape adhering work needs to be done manually, which is labor consuming and inefficient.

The present disclosure has been made to overcome the above problem. In other words, an object of the disclosure is to provide a connector that can be used both for a typical flat conductor and for a flat conductor including a plate and that has high connection reliability.

The present disclosure achieving the above object is configured as below.

The present disclosure is a connector including a housing that forms a housing portion for a flat conductor, the flat conductor including a first connection on a front side in an insertion direction of a flat conductor body, the flat conductor body provided with a conductive line between flat insulation substrates, and a second connection including a conductive member stacked on one surface of one of the insulation substrates of the flat conductor body such that the second connection is formed with a plate thickness that is greater than that of the first connection; and a connector that includes a first terminal that is retained by the housing and that is connected to the flat conductor, and a second terminal that is retained by the housing and that is connected to the flat conductor. In the connector, the housing portion includes a first space in which the first terminal is disposed and that is connected to the first connection, and a second space in which the second terminal is disposed and that is connected to the second connection, and the second space capable of housing the second connection is formed larger than the first space in a plate thickness direction of the flat conductor by a thickness that is equivalent to or greater than the thickness of the conductive member.

If the entire housing portion were to have a size that is capable of housing the second connection that is formed thicker than the first connection, the housing portion will become too large in the thickness direction of the flat conductor and a gap will be created between the first connection and the inner wall of the housing portion. With the above, there are cases in which the connection between the first connection and the first terminal becomes unstable.

Conversely, the housing portion of the present disclosure includes the first space in which the first terminal is disposed and that is connected to the first connection, and the second space in which the second terminal is disposed and that is connected to the second connection. By forming the first space and the second space separately, a large gap can be prevented from being created between the inner wall of the housing portion and the first connection. Accordingly, there will be no need to close the gap by using another member such as, for example, tape, and the connection reliability between the first connection and the first terminal can be improved.

Furthermore, the second space of the present disclosure is formed larger than the first space in the plate thickness direction of the flat conductor by a thickness that is equivalent to or greater than the thickness of the conductive member, and the second space is capable of housing the second connection. Accordingly, by providing the first space and the second space that have different sizes in the thickness direction of the flat conductor, the first connection and the second connection can be conductively connected in a stable manner to the first terminal and the second terminal, respectively. Accordingly, a connector with high connection reliability can be fabricated even if the connector is used both for the typical flat conductor and for the flat conductor including the plate.

The housing of the present disclosure may include an elastic lock piece that is locked to the flat conductor and the elastic lock piece may include a lock protrusion that is locked to the flat conductor and an operation portion that is exposed to an outside of the housing and that is provided along an outer surface of the housing.

Since the housing includes the elastic lock piece that is locked to the flat conductor, the flat conductor can be reliably fixed to the connector. Furthermore, since the elastic lock piece includes the operation portion that is exposed to the outside of the housing, the operation of locking and unlocking the flat conductor with the elastic lock piece, for example, can be facilitated. Furthermore, since the operation portion is provided along the outer surface of the housing, compared to a case, for example, in which the operation portion greatly protrudes towards the outside from the outer surface of the housing, the overall connector can be small in size.

The housing of the present disclosure may include an elastic lock piece that is locked to the flat conductor and the elastic lock piece may include a plurality of lock protrusions that are locked to the flat conductor at positions that are different from each other in a width direction of the flat conductor and a single operation portion that is exposed to an outside of the housing, the single operation portion being pressed so as to displace the plurality of lock protrusions in the thickness direction of the flat conductor so that the locked state with the flat conductor is cancelled.

Since the housing includes the elastic lock piece including the plurality of lock protrusions that are locked to the flat conductor, the flat conductor can be fixed to the connector in a further reliable manner. Furthermore, since the elastic lock piece includes the operation portion that is exposed to the outside of the housing, the operation of locking and unlocking the flat conductor with the elastic lock piece, for example, can be facilitated.

Furthermore, in the above case, if supposing that the plurality of lock protrusions are each provided with an operation portion that interlocks with the corresponding lock protrusion and that all of the operation portions corresponding to the lock protrusions need to be pressed in order to cancel the locked state of the flat conductor including a plate locked with the plurality of lock protrusions, then, work efficiency will be low and the workload on the operator will be large. Conversely, the housing of the present disclosure includes a single operation portion that, by being pressed, displaces the plurality of lock protrusions in the thickness direction of the flat conductor so as to cancel the locked state between the plurality of lock protrusions and the flat conductor. Accordingly, by pressing a single operation portion, the operator is capable of canceling the locked state of the flat conductor locked by the plurality of lock protrusions, thus, unlocking work can be performed efficiently.

The housing of the present disclosure may include a wall that forms the housing portion and a metal reinforcement member that is fitted along the wall. Accordingly, the wall can be made so as not to be easily deformed even when the wall is pressed by the flat conductor inserted into the housing portion.

The second terminal of the present disclosure may be provided by partially extending the reinforcement member into the second space. Accordingly, the second terminal and the reinforcement member can be formed integrally and the number of parts can be reduced. Furthermore, since it is possible to install the second terminal and the reinforcement member in the housing with a single operation, efficiency of assembly work can be increased.

The reinforcement member of the present disclosure may include a fixed portion that is positioned on the bottom surface of the housing opposing a circuit board and that is soldered to the circuit board. With the above, since the portion where soldering is performed does not protrude to the outside; accordingly, the mounting area can be made small.

In the present disclosure, the flat conductor may include an edge portion that extends in a width direction of the flat conductor, and the elastic lock piece may be locked to the edge portion. With the above, the flat conductor is not easily dislocated from the connector, and the connection reliability with the flat conductor can be improved.

The elastic lock piece of the present disclosure may include an elastic arm that extend towards an inside of the housing from the operation portion and that is elastically displaced in the thickness direction of the flat conductor when a press operation is performed on the operation portion. The lock protrusion may be provided in the elastic arm and may be capable of being attached to and detached from the flat conductor when the elastic arm is elastically displaced.

By providing the operation portion to the elastic lock piece, the elastic lock piece can be operated from the outside of the housing; accordingly, it will be possible to easily detach the lock protrusion from the flat conductor and to easily disconnect and remove the flat conductor from the housing. Furthermore, by providing the elastic arm that is elastically displaced and the lock protrusion in an integral manner, compared to a case in which the elastic arm and the lock protrusion are provided separately, the elastic lock piece can be made compact in a further manner.

The operation portion of the present disclosure may be provided so as to oppose the outer surface of the housing and a recess into which the operation portion is elastically displaced may be provided in the outer surface of the housing.

By providing the operation portion so as to oppose the outer surface of the housing, compared with a case in which the operation portion is disposed at a position away from the housing, the overall connector can be made compact. However, in such a case, a space for the operation portion to sufficiently elastically displace itself while not interfering with the housing needs to be provided between the operation portion and the outer surface of the housing. If the operation portion is set away from the outer surface of the housing in order to achieve the above, the overall connector becomes large. Conversely, as in the present disclosure, by providing the recess into which the operation portion is elastically displaced in the outer surface of the housing, the above space can be provided without setting the operation portion greatly away from the housing. Accordingly, the operation portion of the elastic lock piece can be provided without making the size of the overall connector large.

The operation portion of the present disclosure may be elastically displaced along the outer surface of the housing.

When the connector is mounted on the circuit board where other components are mounted in a dense manner, there are cases in which there is no space between the housing and the other mounted components for elastically displacing the operation portion. In such a case, it is difficult to, for example, displace the operation portion in a direction that is orthogonal to the outer surface of the housing or in a direction that displaces the operation portion away from the housing. Conversely, by elastically displacing the operation portion along the outer surface of the housing, even if there is no sufficient space around the housing for elastically displacing the operation portion, the operation portion can be operated.

In the present disclosure, the connector may be mounted on the circuit board and the insertion direction may be parallel with respect to the surface of the circuit board.

With the above, the overall connector can be made short in height; accordingly the connector can be mounted on a circuit board that is disposed in a tight space. Furthermore, even if it is difficult to sight the connector from a direction that is orthogonal to the surface of the circuit board, the flat plate can be inserted.

The connector may be mounted on the circuit board and the insertion direction may be orthogonal to the surface of the circuit board.

With the above, the connector may be a connector with a small mounting area; accordingly, the connector can be mounted in a further small space on the circuit board. Furthermore, even if it is difficult to sight the connector from a direction that is parallel to the surface of the circuit board, the flat plate can be inserted.

According to the connector of the present disclosure, a single connector can be used for both connecting a typical flat conductor and the flat conductor including a plate, and connection reliability with the typical flat conductor and with the flat conductor including a plate can be increased. Accordingly, there are various advantages for the user and the manufacturer, such as reduction in manufacturing cost and elimination of the need to select adapting connectors.

DESCRIPTION OF THE PREFERRED EMBODIMENTS

Figure 1:
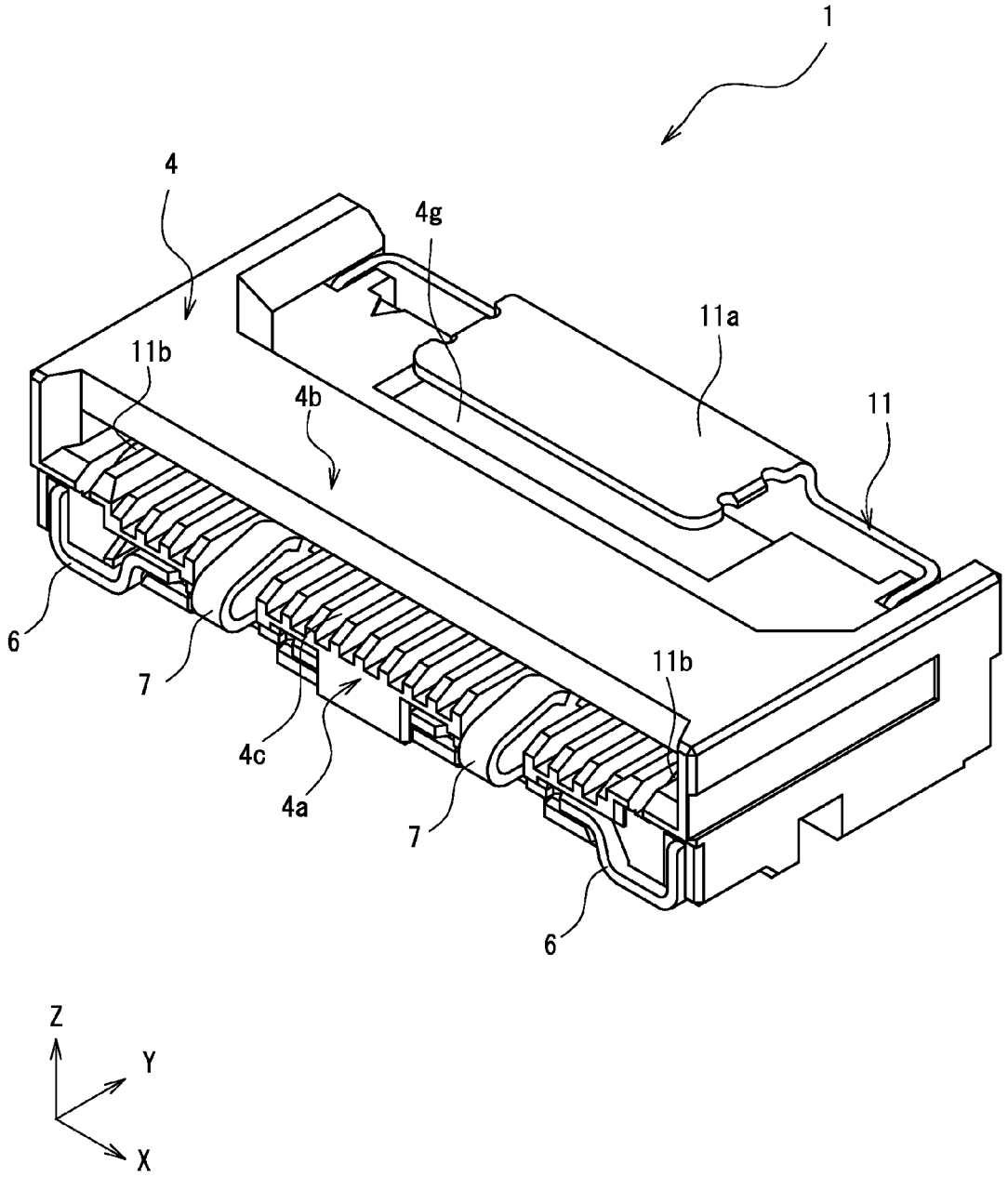
FIG. 1 is a perspective view illustrating a connector of a first embodiment.
Figure 2:
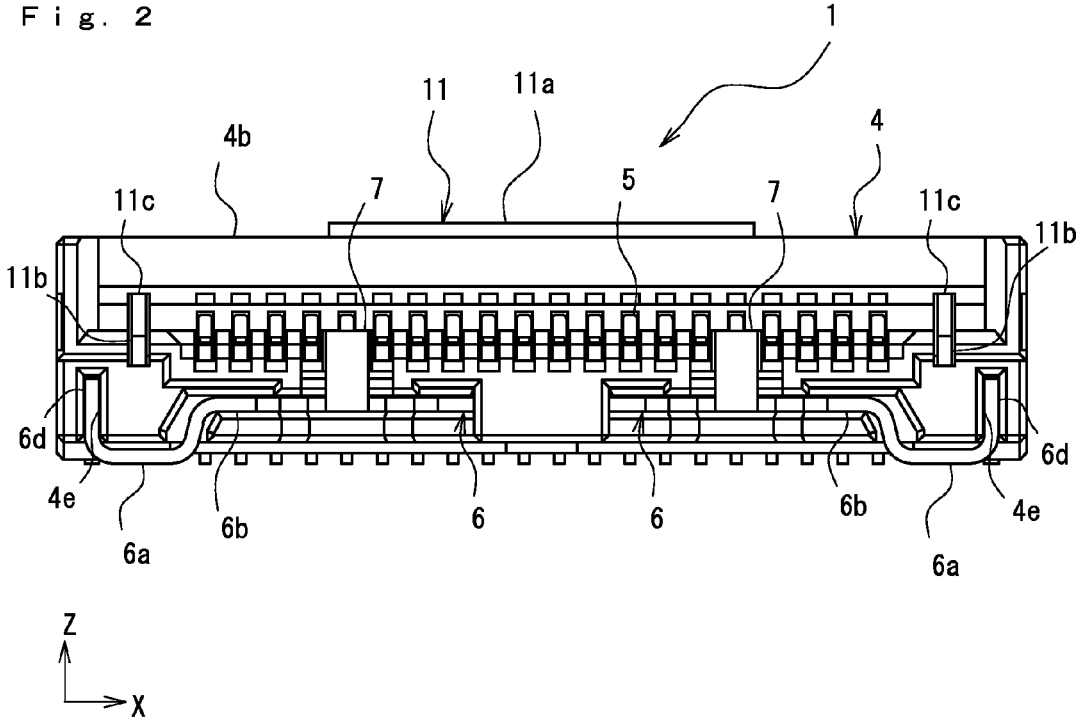
FIG. 2 is a front view illustrating the connector of FIG. 1.
Figure 3:
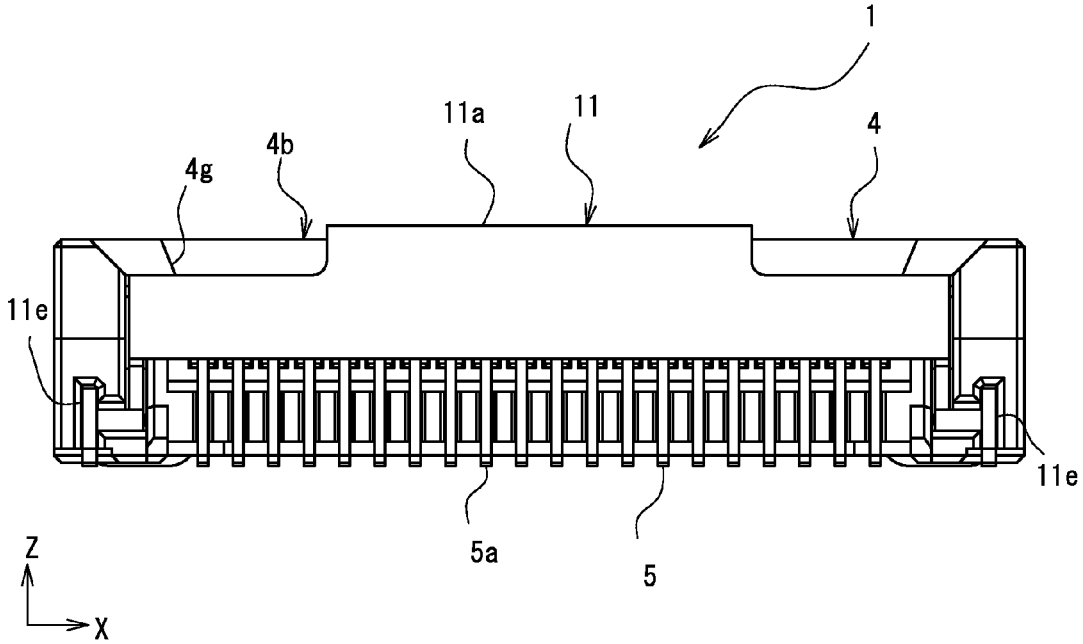
FIG. 3 is a rear view illustrating the connector of FIG. 1.
Figure 4:
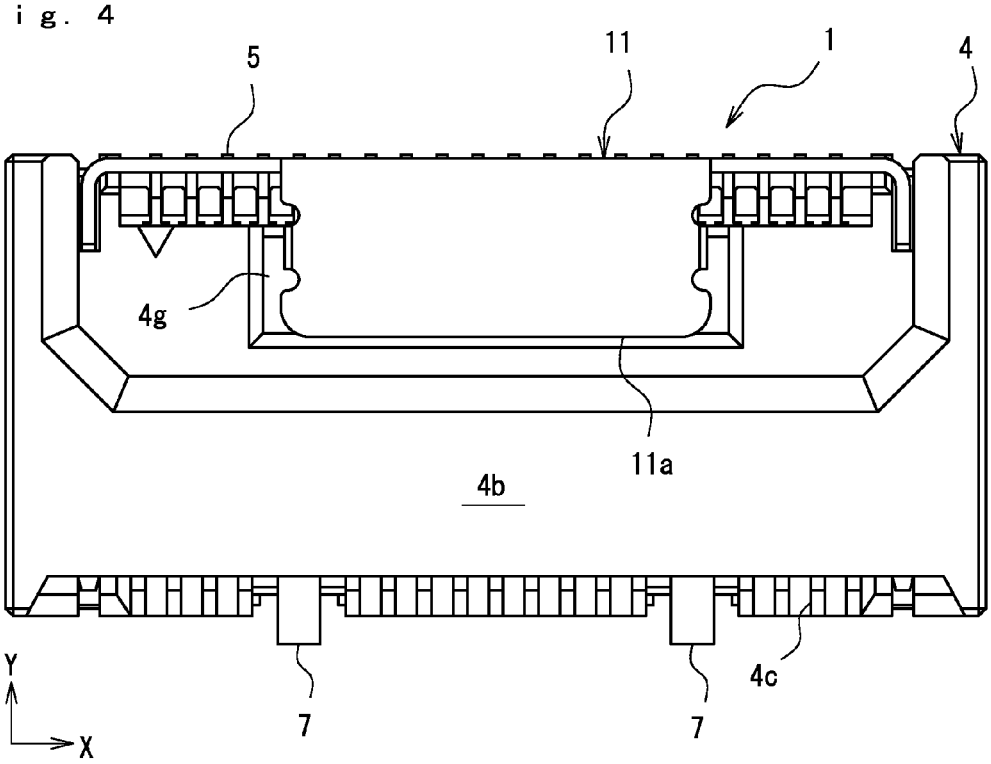
FIG. 4 is a plan view illustrating the connector of FIG. 1.
Figure 5:
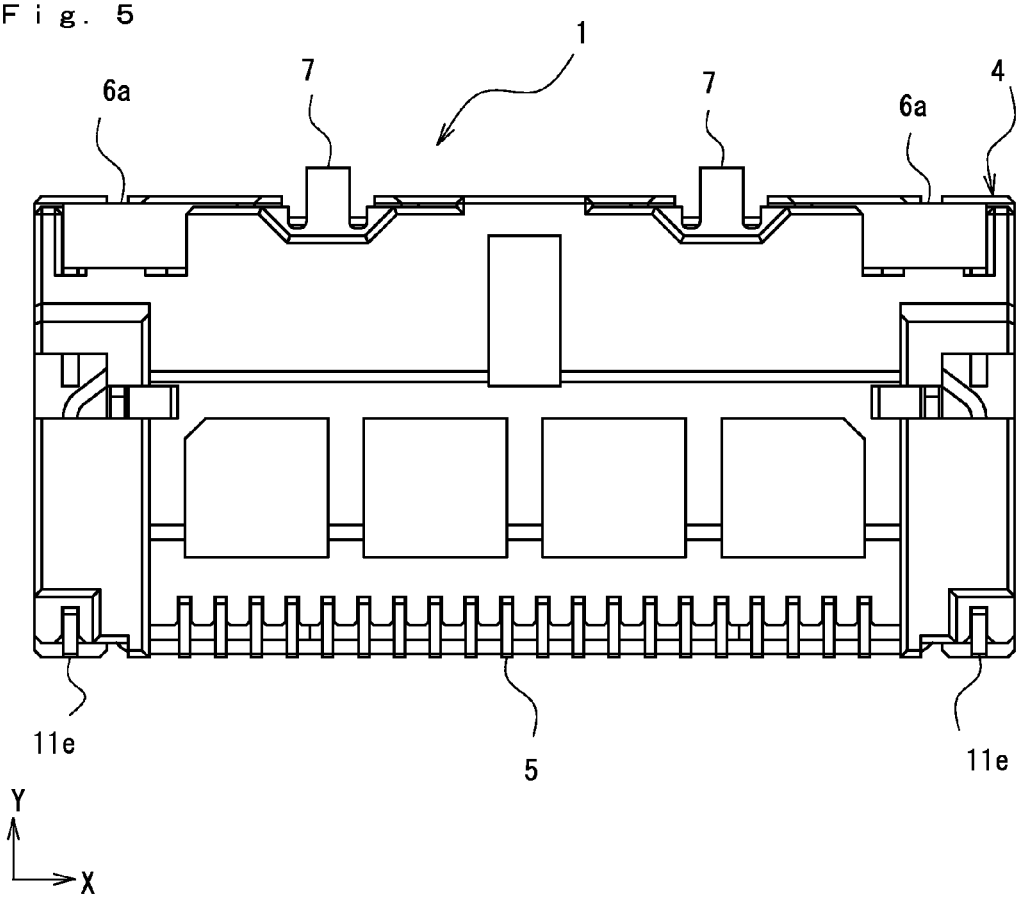
FIG. 5 is a bottom view illustrating the connector of FIG. 1.
Figure 6:
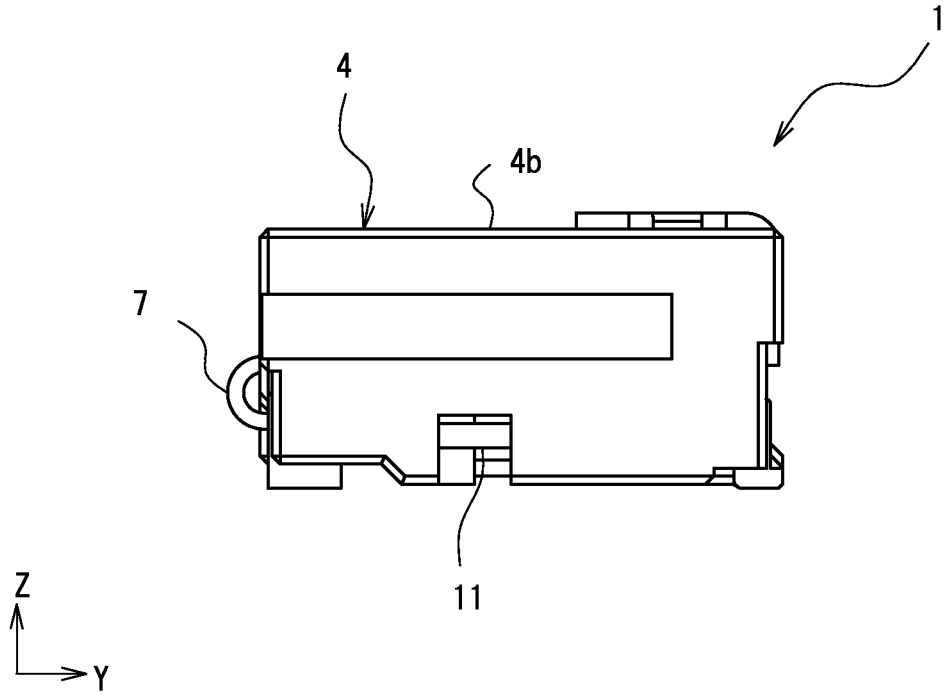
FIG. 6 is a right side view illustrating the connector of FIG. 1.
Figure 7:
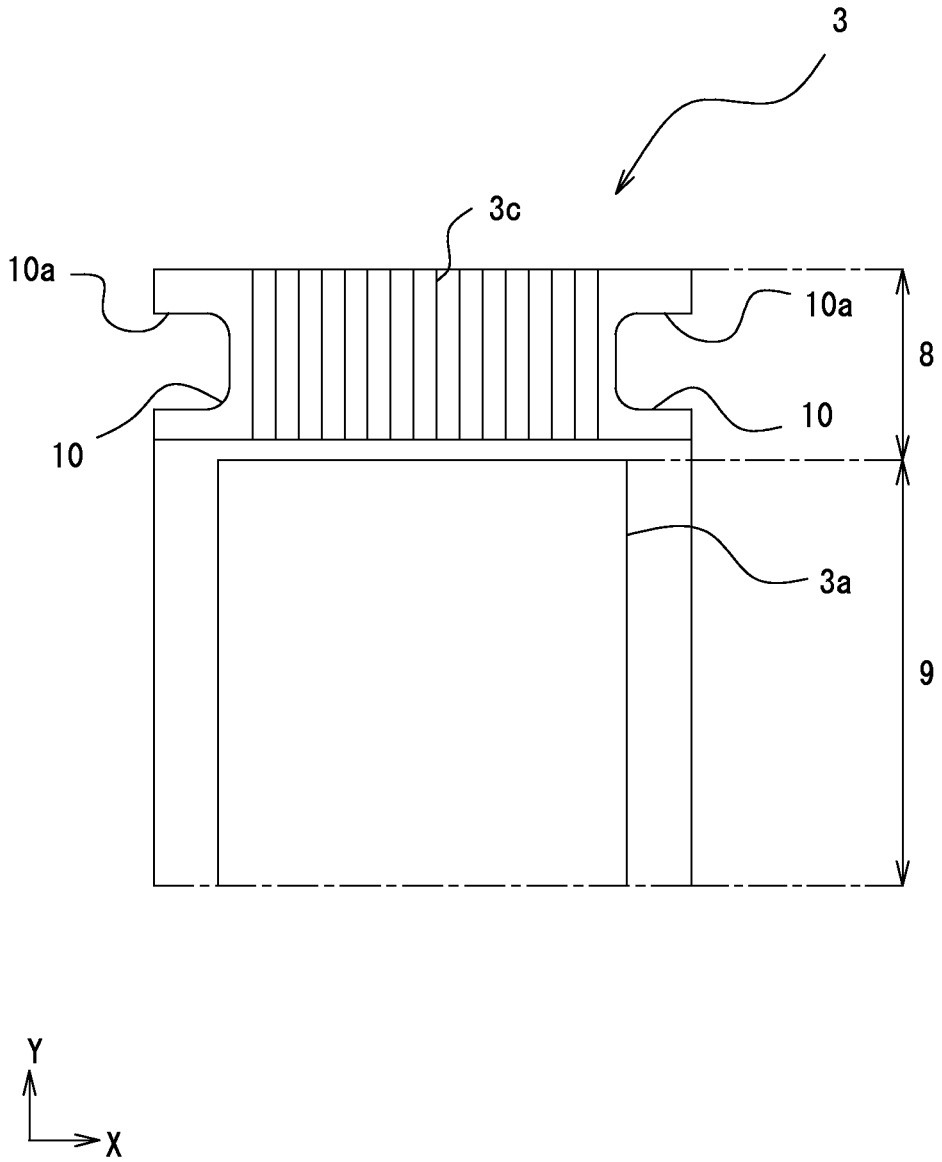
FIG. 7 is a bottom view of a flat conductor including a plate.

Hereinafter, preferred embodiments of a connector of the present disclosure will be described with reference to the drawings. Connectors 1 and 12 illustrated in the embodiments below that are mounted on a circuit board 2. The connectors 1 and 12 that each conductively connect, to a plated circuit, a flat conductor 3 having a plate such as, for example, an FPC or an FFC serving as a "flat conductor" will be described.

First Embodiment (FIGS. 1 to 13)

As illustrated in FIGS. 1 to 13, the connector 1 includes a housing 4, terminals 5 serving as a "first terminal", reinforcement members 6, and ground terminals 7 serving as a "second terminal". The connector 1 is mounted on the circuit board 2 and conductively connects a flat conductor 3 including a plate to the circuit board 2. The flat conductor 3 including a plate serving as the "flat conductor" includes a first connection 8 that is provided on the front side in the insertion direction (Y direction) of the flat conductor 3 including a plate and that is conductively connected to the terminals 5 of the connector 1, and a second connection 9 that is formed thicker than the first connection 8 by having a ground plate 3*a* serving as a "conductive member" stacked thereon.

Note that in the present embodiment, description will be given while a direction that is parallel to the circuit board 2 and that extends in the longitudinal direction of the connector 1 is referred to as an X direction, and a direction that extends in the transverse direction of the connector 1 is referred to as a Y direction. Furthermore, the description will be given while the height direction of the connector 1 is a Z direction. Moreover, the description will be given while, in a height direction Z of the connector 1, the side on the circuit board 2 is referred to as a "lower side" and the side on the connector 1 is referred to as an "upper side"; however, the above do not restrict the fitting direction of the connector 1 and the manner in which the connector 1 is mounted on the circuit board 2.

The connector 1 according to the present embodiment is placed flat with respect to the circuit board 2, and the flat conductor 3 including a plate is connected to the connector 1 by being inserted in a parallel direction with respect to the surface of the circuit board 2. Accordingly, even if it is difficult to sight the connector 1 and a slot 4*a* thereof from a direction orthogonal to the circuit board 2, for example, it will be possible to insert the flat conductor 3 including a plate. Furthermore, such a flat-placed type connector 1 is low in height and the diameters in a transverse direction Y and in a longitudinal direction X thereof are longer than the diameter in the height direction Z thereof. Accordingly, since the connector 1 is stable when mounted on the circuit board 2 and does not easily fall down, when inserting the flat conductor 3 including a plate therein and when pressing an operation portion 11*a* of an elastic lock piece 11, it is possible to avert a situation such as the mounted connector 1 coming off and falling down on the circuit board 2 from easily occurring.

As illustrated in FIGS. 7, 10 to 13, and 23 to 26, the flat conductor 3 including a plate includes a cable body 3*b* serving as a "flat conductor body". In the cable body 3*b*, insulating layers 3*d* serving as "insulation substrates" are stacked on both the upper and lower surfaces of a layer including conductive lines 3*c*. The conductive lines 3*c* are exposed to the outside at the front side of the cable body 3*b* in the insertion direction when the cable body 3*b* is inserted into the housing 4. The above portion serving as the first connection 8 is conductively connected to the terminals 5 of the connector 1.

Furthermore, the ground plate 3*a* is provided on a surface on the lower side (the side that comes into contact with the ground terminals 7 of the connector 1) of the flat conductor 3 including a plate and is stacked on the flat conductor 3 including a plate in an area other than the two ends of the flat conductor 3 including a plate in the width direction. The portion where the ground plate 3*a* is provided, serving as the second connection 9, is conductively connected to the ground terminals 7. Furthermore, since the ground plate 3*a* is formed in the cable body 3*b*, the second connection 9 is formed thicker than the first connection 8.

A recess 10 is formed in each of the two sides of the first connection 8 in the width direction of the flat conductor 3 including a plate. Each recess 10 illustrated in the present embodiment is formed as a notch that is the lateral side of the flat conductor 3 including a plate cut away in a concave manner. However, each recess 10 may be a hole or may have any other shape that allows the elastic lock piece 11 described later to function as a "lock portion" that can lock and retain the flat conductor 3 including a plate. Furthermore, the recesses 10 include edge portions 10*a* that extend in the width direction of the flat conductor 3 including a plate. Lock protrusions 11*c* of the elastic lock piece 11 described later are locked to the edge portions 10*a*.

A configuration of the connector 1 will be described next.

Housing

The housing 4 is formed of insulating resin and, as illustrated in FIGS. 1 to 6, is formed in a substantially rectangular parallelepiped shape. The slot 4*a* for inserting the flat conductor 3 including a plate into the connector 1 is formed in one of the sidewalls constituting the housing 4. A recess 4*g* that is formed along the shape of the operation portion 11*a* of the elastic lock piece 11 described below is formed in the upper surface of the housing 4 at a position that is the far side with respect to the insertion direction of the flat conductor 3 including a plate.

Furthermore, a housing portion 4*f* for the flat conductor 3 including a plate is provided on the inner side of the housing 4. The terminals 5 are capable of being elastically deformed in the housing portion 4*f* mainly in the height direction Z. The housing portion 4*f* includes a first space 4*f*1 and a second space 4*f*2.

First Space

As illustrated in FIGS. 1 to 3, 10, and 11, the terminals 5 are disposed in the first space 4*f*1. Here, in the first space 4*f*1, the terminals 5 and the first connection 8 of the flat conductor 3 including a plate are conductively connected to each other. A top surface portion 4*b* is provided on the upper side of the first space 4*f*1 in the height direction Z and slits 4*c* is formed on the lower side of the first space 4*f*1 in the height direction Z. The terminals 5 protrude into the first space 4*f*1 through the slits 4*c* and come into contact with the first connection 8 of the flat conductor 3 including a plate from under. Then, the terminals 5 press the flat conductor 3 including a plate against the top surface portion 4*b*.

Second Space

As illustrated in FIGS. 1 to 3, 10, and 11, the ground terminals 7 are disposed in the second space 4*f*2. Here, the ground terminals 7 and the ground plate 3*a* come into contact with each other. The second space 4*f*2 is provided adjacent to the first space 4*f*1. An inclined portion 4*f*3 is formed in the second space 4*f*2 between the first space 4*f*1 and the second space 4*f*2, and the second space 4*f*2 is larger than the first space 4*f*1 in the height direction Z. Accordingly, the second connection 9 that is thicker than the first connection 8 by the thickness of the ground plate 3*a* can be housed in the second space 4*f*2.

Terminal

Figure 10:
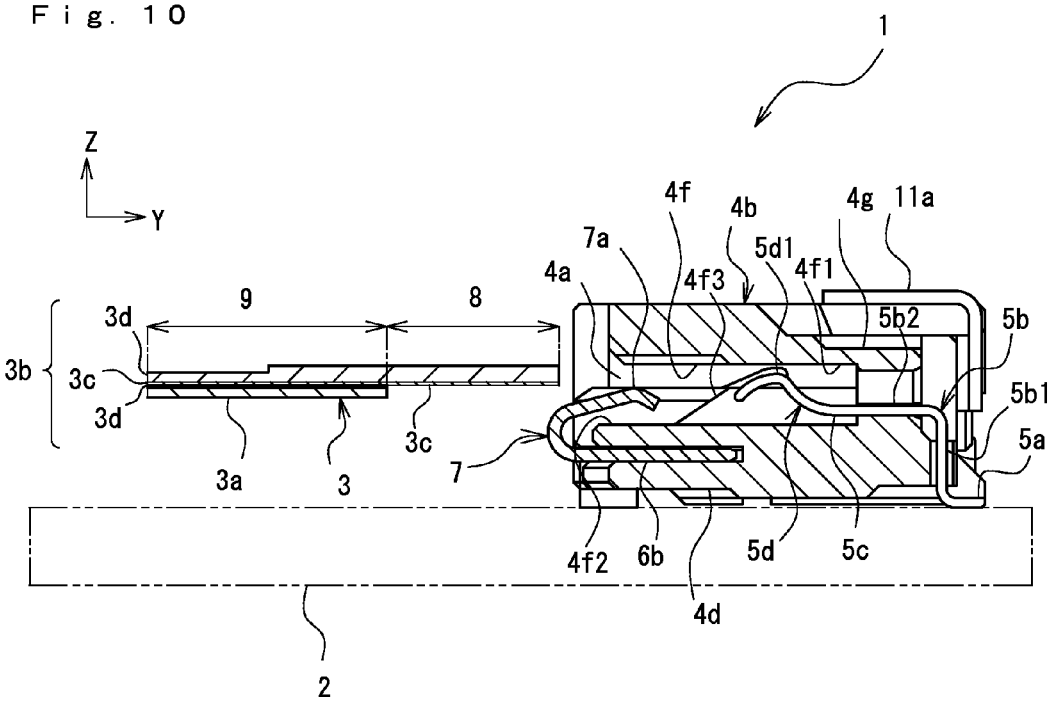
FIG. 10 is an explanatory drawing of a fitting state between the connector of FIG. 1 and the flat conductor.
Figure 11:
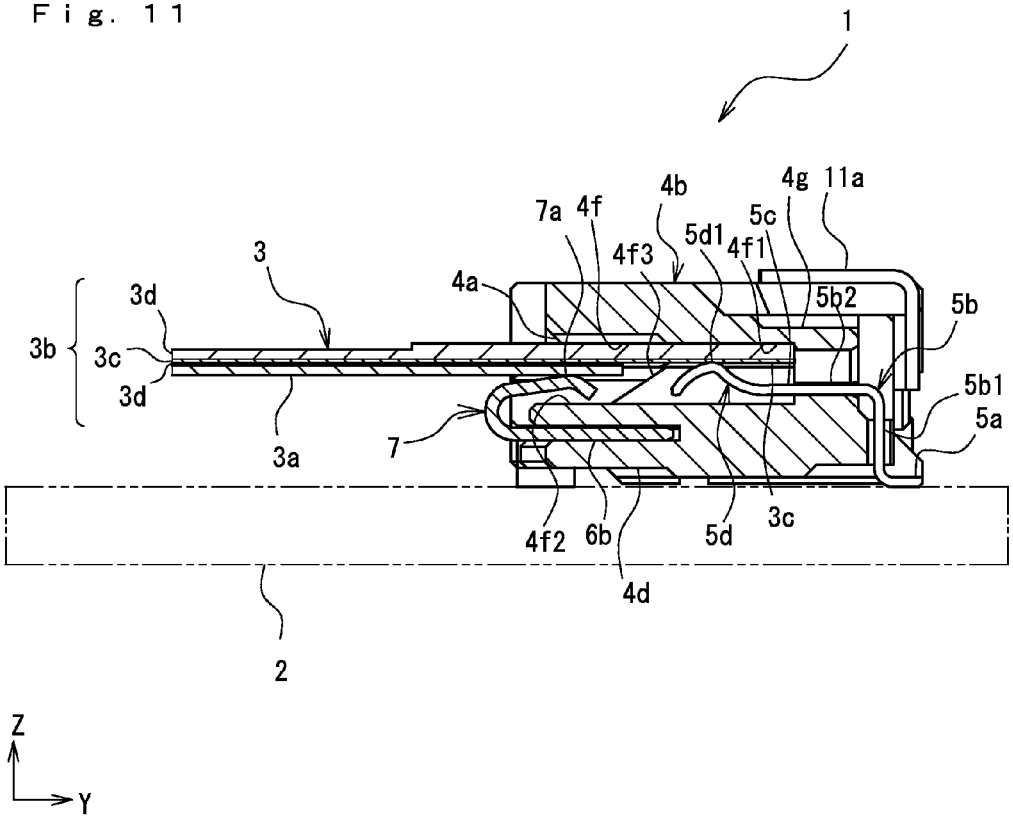
FIG. 11 is an explanatory drawing of a fitting state between the connector of FIG. 1 and the flat conductor.

Each of the terminals 5 is formed by bending a conductive metal plate and, as illustrated in FIGS. 10 and 11, includes a circuit board connection 5*a*, a fixed portion 5*b*, an elastic piece 5*c*, and a contact portion 5*d*. Furthermore, a plurality of terminals 5 are arranged parallel to each other in the longitudinal direction X of the housing 4.

Each circuit board connection 5*a* is provided on one end side of the corresponding terminal 5, extends to the outside of the housing 4, and is soldered and fixed to the circuit board 2.

The fixed portion 5*b* includes a vertical piece 5*b*1 and a horizontal piece 5*b*2, and the lower end of the vertical piece 5*b*1 is coupled to the circuit board connection 5*a*. Furthermore, the horizontal piece 5*b*2 penetrates through a wall 4*d* of the housing 4 and, here, the terminal 5 is fixed to the housing 4. The terminals 5 and the housing 4 are integrally formed by insert molding and the terminals 5 are fixed to the housing 4 at the fixed portions 5*b*.

The elastic piece 5*c* extends towards the slot 4*a* side from the end portion of the horizontal piece 5*b*2 of the fixed portion 5*b* in a cantilevered manner. Furthermore, the elastic piece 5*c* elastically deforms in the height direction Z of the connector 1 while the horizontal piece 5*b*2 of the fixed portion 5*b* serves as a fulcrum. Furthermore, the contact portion 5*d* is elastically supported at the distal end side of the elastic piece 5*c*.

The contact portion 5*d* is a portion that is conductively connected to the flat conductor 3 including a plate. Furthermore, the contact portion 5*d* is bent in a mountainous shape extending in a direction that comes in contact with the circuit board and a contact portion 5*d*1 that is conductively connected to the flat conductor 3 including a plate is formed at a substantially middle portion thereof.

Reinforcement Member

The reinforcement members 6 are each formed of a metal plate and reinforce the wall 4*d* that forms the housing portion 4*f*. Furthermore, as illustrated in FIGS. 1, 2, 10, and 11, a reinforcement member 6 is provided on each of the two sides of the housing 4 in the longitudinal direction X in a portion on the lower side and on the slot 4*a* side of the housing 4. The pair of reinforcement members 6 are formed so as to be bilaterally symmetrical with each other.

Figure 8:
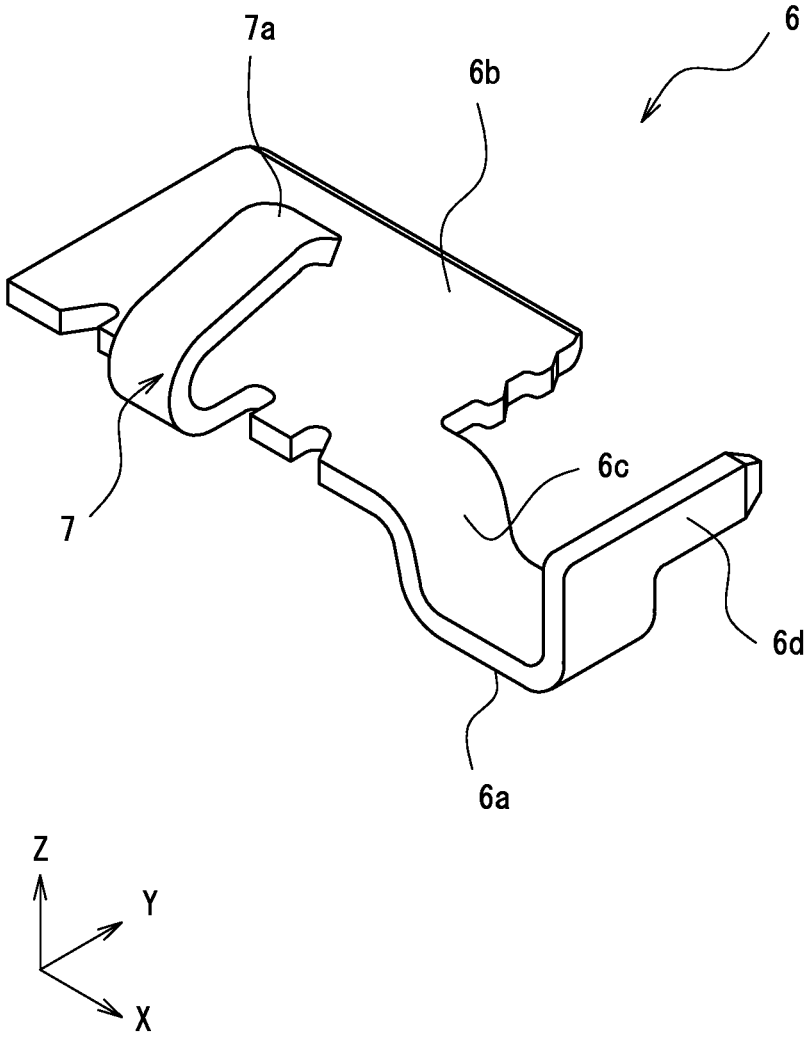
FIG. 8 is a perspective view illustrating a reinforcement member of the first embodiment.
Figure 9:
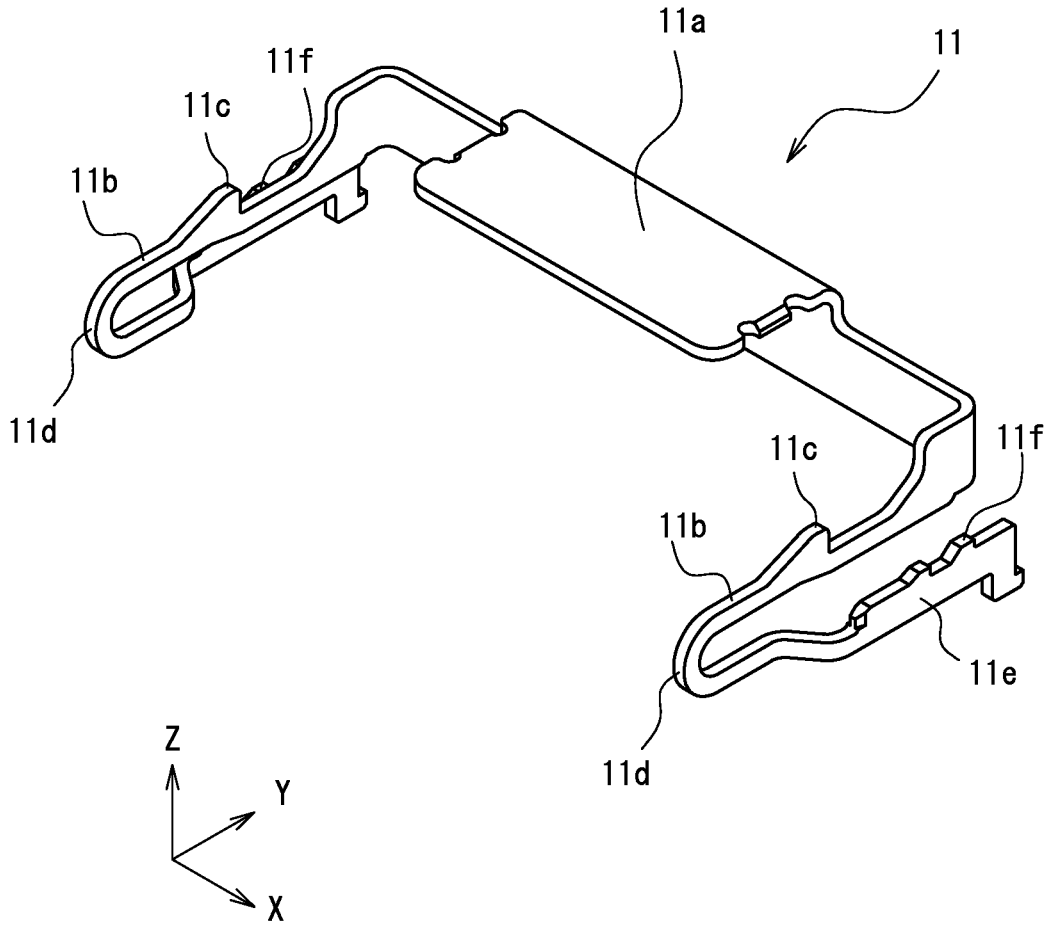
FIG. 9 is a perspective view illustrating an elastic lock piece of the first embodiment.

As illustrated in FIG. 8, each reinforcement member 6 includes a fixed portion 6*d* that is fixed to the housing 4, a ground connection 6*a* formed of a plate surface that is parallel to the bottom surface of the housing 4, a reinforcing plate 6*b* that reinforces the wall 4*d* on the bottom surface side of the housing 4, and a step 6*c* formed between the reinforcing plate 6*b* and the ground connection 6*a*.

The fixed portion 6*d* is press fitted into and fixed to a press-fitting hole 4*e* provided on the bottom surface side of the housing 4.

Each ground connection 6*a* is exposed to the outside from the lower side of the housing 4 and is soldered to a corresponding ground connection pad of the circuit board 2. The ground connection 6*a* does not protrude outside the housing 4 and is within the plane of the bottom surface of the housing 4; accordingly, the connector 1 can be made compact and can be mounted on the circuit board 2 while occupying a small area on the circuit board 2. When the flat conductor 3 including a plate is connected to the connector 1, the ground connection 6*a* can connect the flat conductor 3 including a plate and the circuit board 2 to each other. Since the bottom surface side of the ground connection 6*a* functions as a soldering portion with respect to the circuit board 2, the connector 1 can be fixed to the circuit board 2 at the above portion. Each fixed portion 6*d* is positioned on the bottom surface side of the housing 4 and does not protrude outside the housing 4. Accordingly, the connector 1 can be made further compact.

Each reinforcing plate 6*b* is inserted in the plate thickness of the wall 4*d* serving as a bottom wall of the housing 4 and is not exposed to the bottom surface side of the housing 4. By providing the reinforcing plates 6*b*, the wall 4*d* can be made to not deform easily when the wall 4*d* is pressed by the flat conductor 3 including a plate that is inserted into the housing portion 4*f*.

Ground Terminal

The ground terminals 7 are each formed of conductive metal and is provided integrally with the reinforcement members 6. Furthermore, as illustrated in FIGS. 1, 2, 10, and 11, a single ground terminal 7 is provided on each of the two end sides of the housing 4 in the longitudinal direction X. Each of the ground terminals 7 extends towards the slot 4*a* side of the housing 4 from the corresponding reinforcement member 6 and is bent back in a substantially U-shape such that the distal end side extends into the housing portion 4*f*. A bent portion 7*a* that is bent in a mountainous shape and that comes into contact with the second connection 9 of the flat conductor 3 including a plate is provided on the distal end side.

By forming the ground terminal 7 and the reinforcement member 6 in an integral manner, the ground terminal 7 and the reinforcement member 6 can be installed in the housing 4 with a single operation; accordingly, efficiency of assembly work can be increased and the number of parts can be reduced compared to having separate members.

Elastic Lock Piece

The elastic lock piece 11 locks the flat conductor 3 including a plate so that the flat conductor 3 including a plate is not dislocated from the connector 1 and is a member for improving the connection reliability with the flat conductor 3 including a plate. As illustrated in FIGS. 9, and 10 to 13, the elastic lock piece 11 includes the operation portion 11*a* that is exposed to the outside of the housing 4, elastic arms 11*b* that extend towards the inside of the housing 4 from the sides of the two end portions of the operation portion 11*a* and that are elastically displaced in the thickness direction of the flat conductor 3 including a plate when a press operation is performed on the operation portion 11*a*, the lock protrusions 11*c* that are provided in the elastic arms 11*b* and that are attachable and detachable with respect to the edge portions 10*a* of the flat conductor 3 including a plate upon the above elastic displacement, bent portions 11*d* formed in a U-shape, and fixed portions 11*e* that are fixed to the housing 4. The elastic lock piece 11 is structured so that all of the portions from after the operation portion 11*a*, that is, the elastic arms 11*b*, the lock protrusions 11*c*, the bent portions 11*d*, and the fixed portions 11*e* are positioned within the housing 4 and are formed so that there are no portions that protrude to the outside, for example, in the height direction Z of the housing 4; accordingly, the elastic lock piece 11 contributes to making the connector 1 compact particularly in the height direction Z.

The operation portion 11*a* is formed in a tabular shape extending along the outer surface of the top surface portion 4*b* on the upper side of the housing 4 and is provided above the recess 4*g* of the housing 4. Accordingly, the operation portion 11*a* does not greatly protrude from the top surface portion 4*b* of the housing 4 such that the connector 1 can be reduced in size and height. In the present embodiment, the operation portion 11*a* is provided so as to oppose a surface of the top surface portion 4*b* that is the outer surface of the housing 4. By doing so, the overall connector 1 can be made compact compared to a case in which the operation portion 11*a* is disposed so as to be greatly set apart or protruded from the housing 4.

The operation portion 11*a* is pressed towards the housing 4 side when disconnecting and removing the flat conductor 3 including a plate from the connector 1. In such a case, a space for the operation portion 11*a* to elastically displace itself so that the operation portion 11*a* is elastically displaced in a sufficient manner while not interfering with the housing 4 needs to be provided between the operation portion 11*a* and the outer surface of the housing 4. Accordingly, there are cases in which the operation portion 11*a* is set apart from the outer surface of the housing 4, resulting in increase in the size of the overall connector 1. However, as in the present embodiment, by providing the recess 4*g* in the outer surface of the housing 4 into which the operation portion 11*a* elastically displaces itself, the above space can be provided without setting the operation portion 11*a* apart from the housing 4. By having the operation portion 11*a* be elastically displaced into the recess 4*g* of the housing 4, the operation portion 11*a* can be, without increasing the size of the overall connector 1, sufficiently pressed towards the housing 4 side without interfering with the housing 4.

By providing the operation portion 11*a* that is exposed to the outside in a manner described above in the elastic lock piece 11, the elastic lock piece 11 can be operated from the outside of the housing 4; accordingly, it will be possible to easily detach the lock protrusions 11*c* from the flat conductor 3 including a plate and to easily disconnect and remove the flat conductor 3 including a plate from the housing 4.

A single elastic arm 11*b* extends from each of the two ends of the operation portion 11*a* and is disposed inside the housing 4. Each of the elastic arms 11*b* is formed in a linear manner in the transverse direction Y of the housing 4, and a lock protrusion 11*c* described later is formed at a substantially middle portion in the transverse direction Y. Since the elastic arms 11*b* can be elastically displaced in the thickness direction of the flat conductor 3 including a plate, the lock protrusions 11*c* interlocks with the elastic arms 11*b* and is displaced. As described above, by providing the elastic arms 11*b* and the lock protrusions 11*c* in an integral manner, compared to a case in which the elastic arms 11*b* and the lock protrusions 11*c* are provided separately, the elastic lock piece 11 can be made compact.

A single lock protrusion 11*c* is provided in each of the elastic arms 11*b* and 11*b* and is formed so as to protrude in a mountainous shape towards the flat conductor 3 including a plate. Accordingly, a single elastic lock piece 11 includes two lock protrusions 11*c* at different positions in the width direction of the fitted flat conductor 3 including a plate. When the flat conductor 3 including a plate is housed in the housing portion 4*f*, the lock protrusions 11*c* and 11*c* are pressed and displaced towards the lower side with the flat conductor 3 including a plate. From the above state, by having the flat conductor 3 including a plate further penetrate towards the far side of the housing portion 4*f*, the lock protrusions 11*c* and 11*c* move into the recesses 10 of the flat conductor 3 including a plate. The lock protrusions 11*c* and 11*c* includes the edge portions 10*a* that extend in the width direction of the flat conductor 3 including a plate, and the edge portions 10*a* are locked to the recesses 10 of the flat conductor 3 including a plate. In the above locked state, the flat conductor 3 including a plate does not become dislocated even if the flat conductor 3 including a plate is pulled. As described above, by having the two lock protrusions 11*c* at different positions in the width direction of the flat conductor 3 including a plate, and by having the two lock protrusions 11*c* locked to the two recesses 10 included in the flat conductor 3 including a plate, the flat conductor 3 including a plate can be fixed to the connector 1 in a further reliable manner.

The bent portions 11*d* are provided continuously from the elastic arms 11*b* and are formed so as to be bent back towards the lower side in a U-shape from the slot 4*a* side of the elastic arms 11*b* in the transverse direction Y. When the operation portion 11*a* is pressed in the above-described manner, the above bent portions 11*d* become deformed and the portions of the elastic arms 11*b* on the far side in the insertion direction of the flat conductor 3 including a plate are pushed down towards the circuit board 2 side; accordingly, the elastic arms 11*b* are inclined obliquely. With the above, the lock protrusions 11*c* are pushed down towards the circuit board 2 side and are dislocated from the recesses 10 of the flat conductor 3 including a plate; accordingly, the locked flat conductor 3 including a plate is released and the flat conductor 3 including a plate can be disconnected and removed from the connector 1.

The fixed portions 11*e* are formed continuously from the bent portions 11*d* and are formed so as to bend towards the two sides of the housing 4 in the longitudinal direction X. Lock portions 11*f* are provided on the upper side of the fixed portions 11*e* and are fixed to fixing grooves (not shown) provided in the housing portion 4*f* of the housing 4.

Description of the Method of Use

The method of using the connector 1 will be described next.

First, as illustrated in FIGS. 10 and 11, the flat conductor 3 including a plate is inserted into the second space 4*f*2 of the connector 1 through the slot 4*a*. The distal end of the flat conductor 3 including a plate comes into contact with the lock protrusions 11*c* and 11*c* of the elastic lock piece 11, pushes down the lock protrusions 11*c* and 11*c* towards the circuit board 2 side, and goes over the lock protrusions 11*c* and 11*c*. Furthermore, the flat conductor 3 including a plate, while being pressed by the lock protrusions 11*c* and 11*c*, is inserted into the first space 4*f*1 of the connector 1 along the underside of the top surface portion 4*b* in the housing portion 4*f*.

As described above, the ground plate 3*a* is stacked on the flat conductor 3 including a plate in an area other than the two ends of the flat conductor 3 including a plate in the width direction so as to be formed thicker than the first connection 8. Furthermore, the second space 4*f*2 is formed larger than the first space 4*f*1 in the height direction Z of the connector 1. Accordingly, when inserting the first connection 8 of the flat conductor 3 including a plate into the first space 4*f*1, the thick second connection 9 can be made to enter the second space 4*f*2 as well.

Then, when the flat conductor 3 including a plate is made to further penetrate into the far side of the first space 4*f*1 while the elastic lock piece 11 is pushed down, the flat conductor 3 including a plate comes into contact with the contact portions 5*d* of the terminals 5, pushes down the contact portions 5*d*, and goes over the contact portions 5*d*1.

Figure 12:
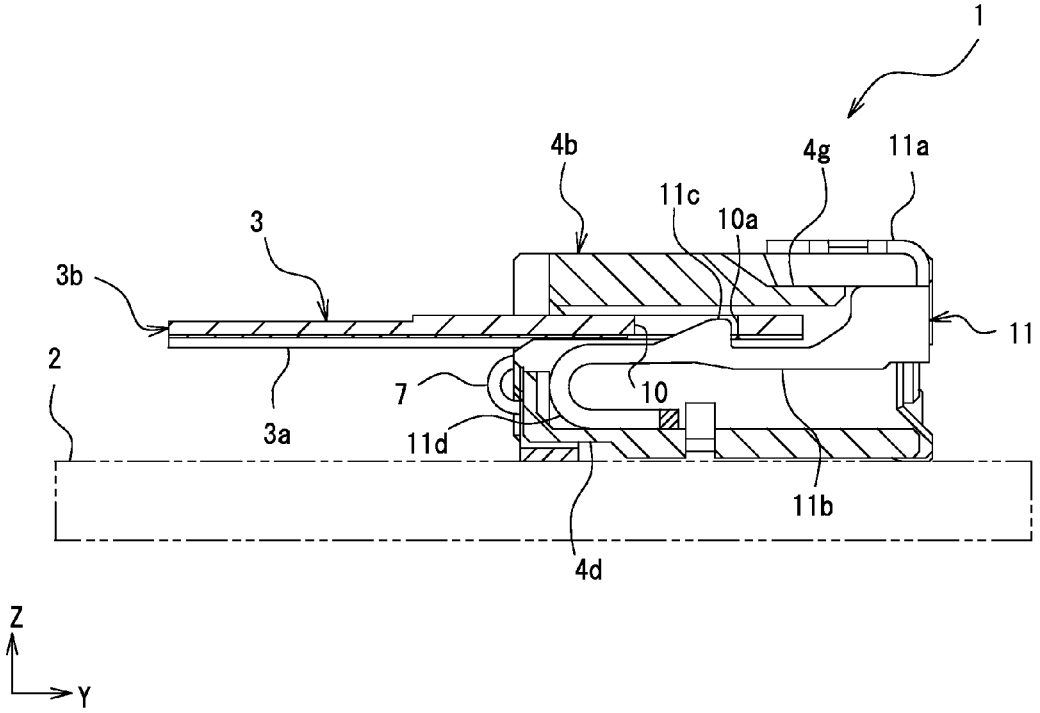
FIG. 12 is an explanatory drawing illustrating a releasing method of the elastic lock piece of the connector of FIG. 1.

Then, the recesses 10 of the flat conductor 3 including a plate reaches the lock portions 11*f* of the elastic lock piece 11. Restoring force that returns the elastic lock piece 11 towards the top surface portion 4*b* side constantly acts on the elastic lock piece 11 in which the lock portions 11*f* are elastically deformed as if falling down. Accordingly, in a state in which the recesses 10 of the flat conductor 3 including a plate have reached the lock portions 11*f* of the elastic lock piece 11, the elastic lock piece 11 moves into the recesses 10 and is restored to its original state. In such a case, the edge portions 10*a* in the lock portions 11*f* of the elastic lock piece 11 become substantially parallel to the edge portions 10*a* of the recesses 10 and lock the connector 1 (FIG. 12).

In the above state, the flat conductor 3 including a plate is pinched by the contact portions 5*d*1 and the top surface portion 4*b* such that the flat conductor 3 including a plate and the terminals 5 are conductively connected to each other.

Figure 13:
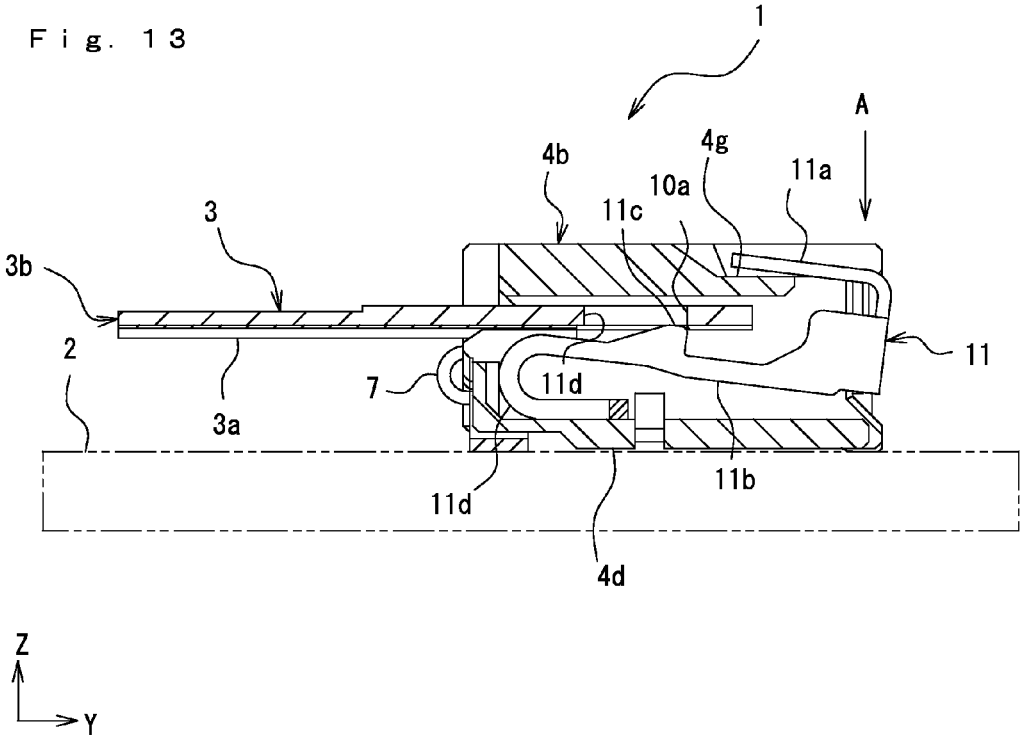
FIG. 13 is an explanatory drawing illustrating a releasing method of the elastic lock piece of the connector of FIG. 1.
Figure 14:
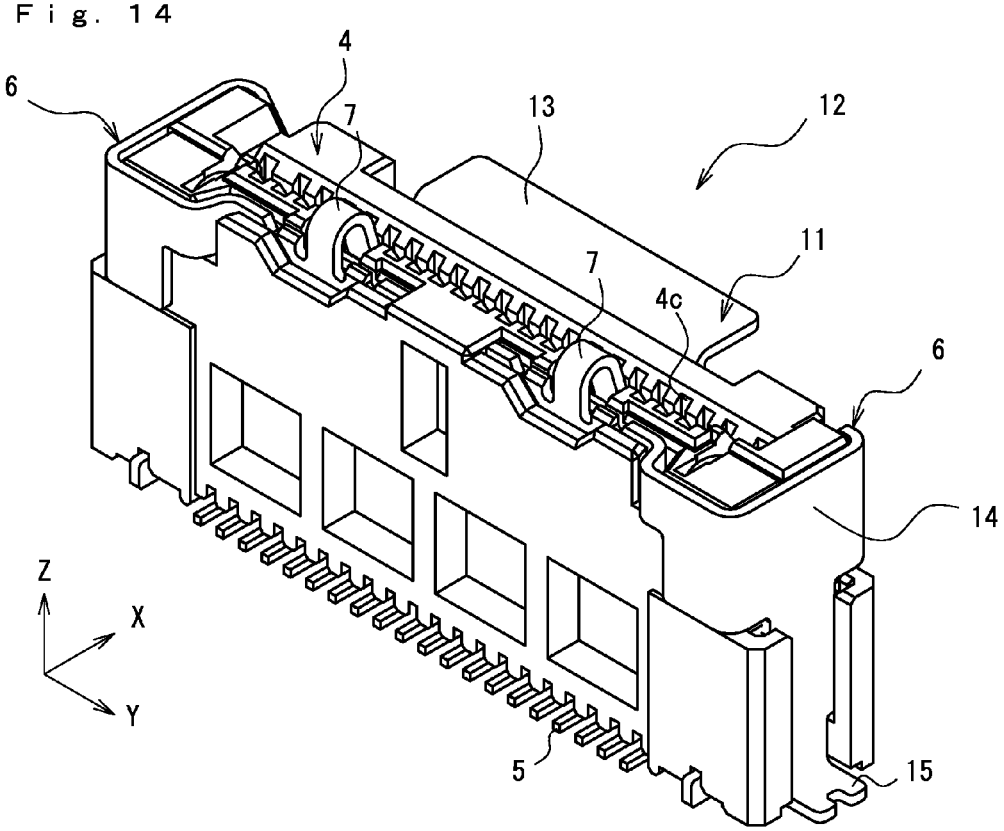
FIG. 14 is a perspective view illustrating a connector of a second embodiment.
Figure 15:
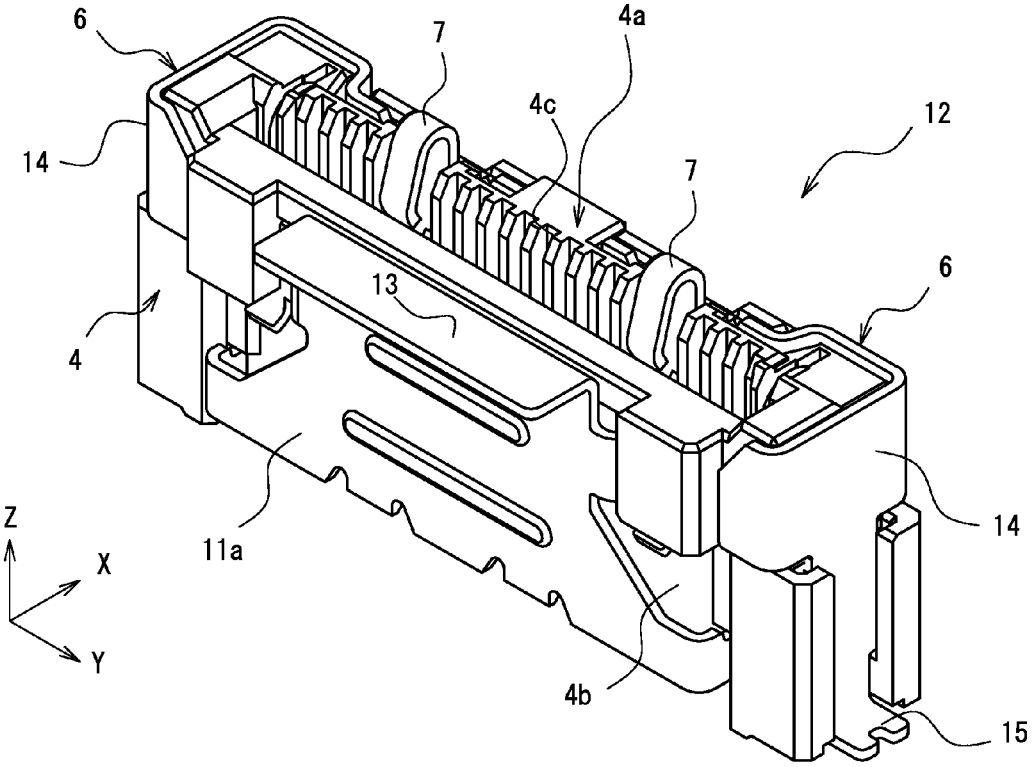
FIG. 15 is a rear side perspective view illustrating the connector of the second embodiment.
Figure 16:
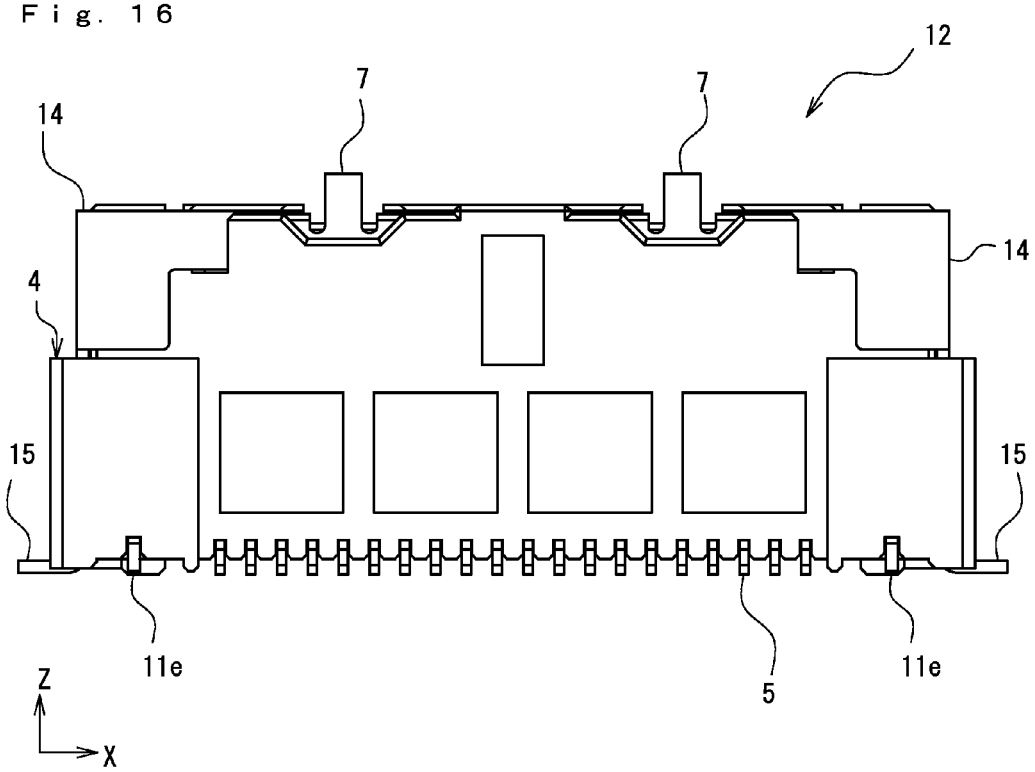
FIG. 16 is a front view illustrating the connector of FIG. 14.
Figure 17:
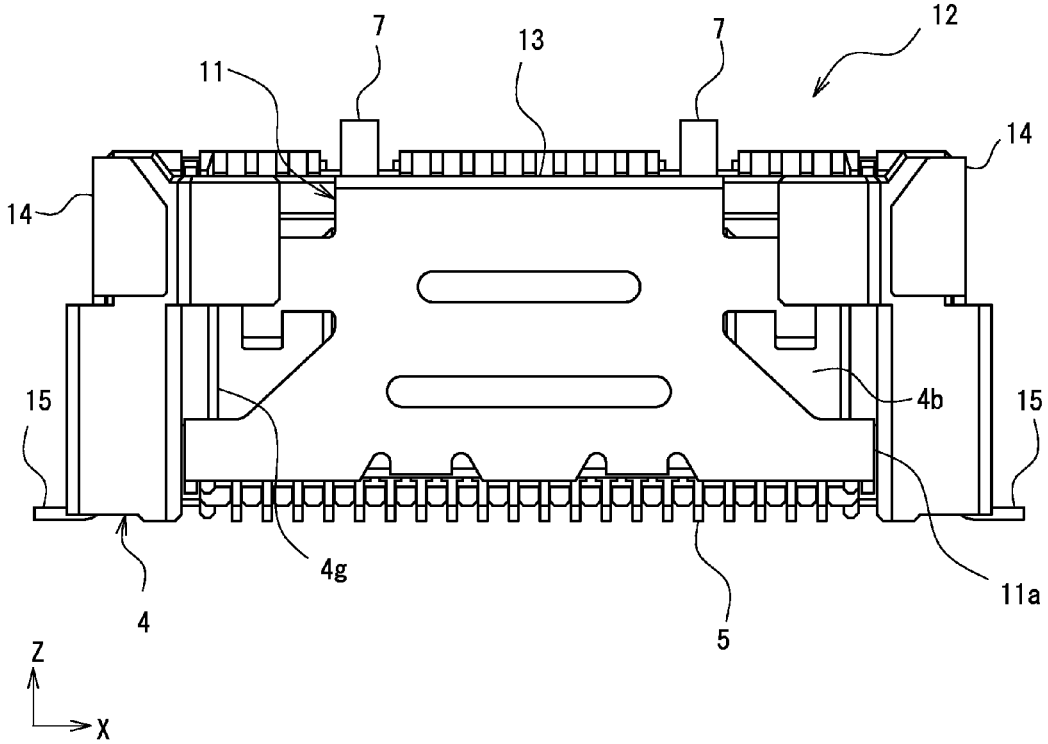
FIG. 17 is a rear view illustrating the connector of FIG. 14.
Figure 18:
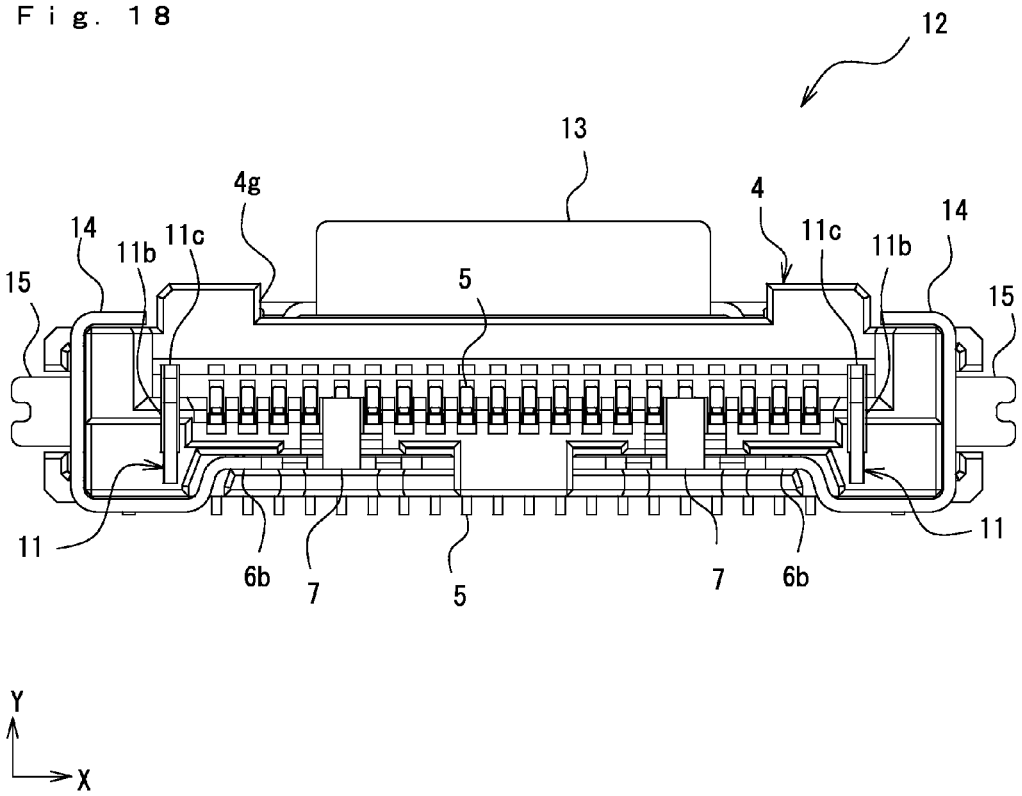
FIG. 18 is a plan view illustrating the connector of FIG. 14.
Figure 19:
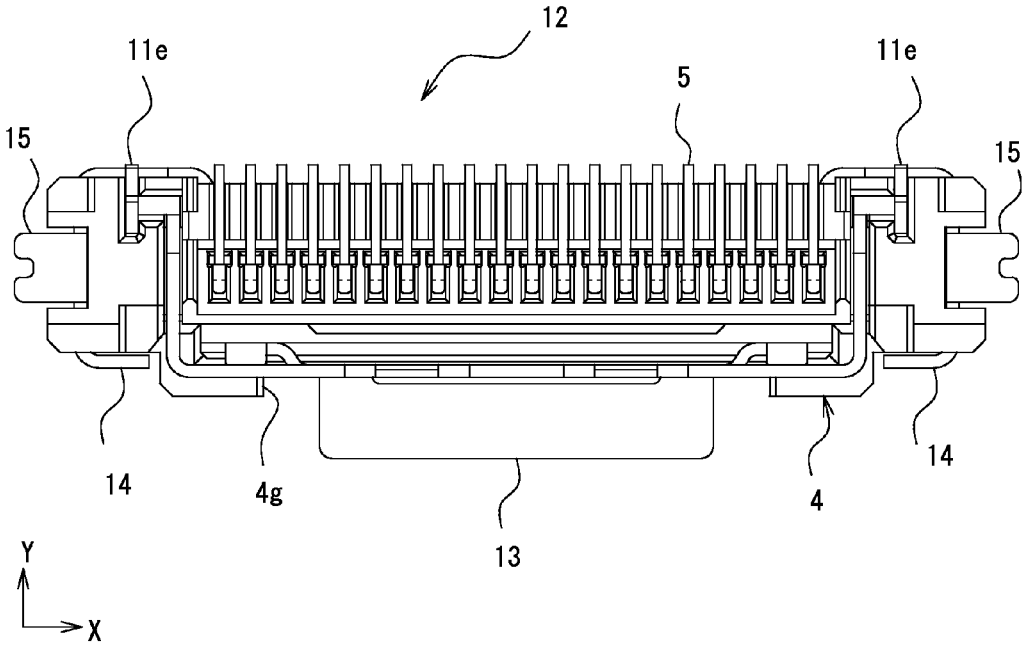
FIG. 19 is a bottom view illustrating the connector of FIG. 14.
Figure 20:
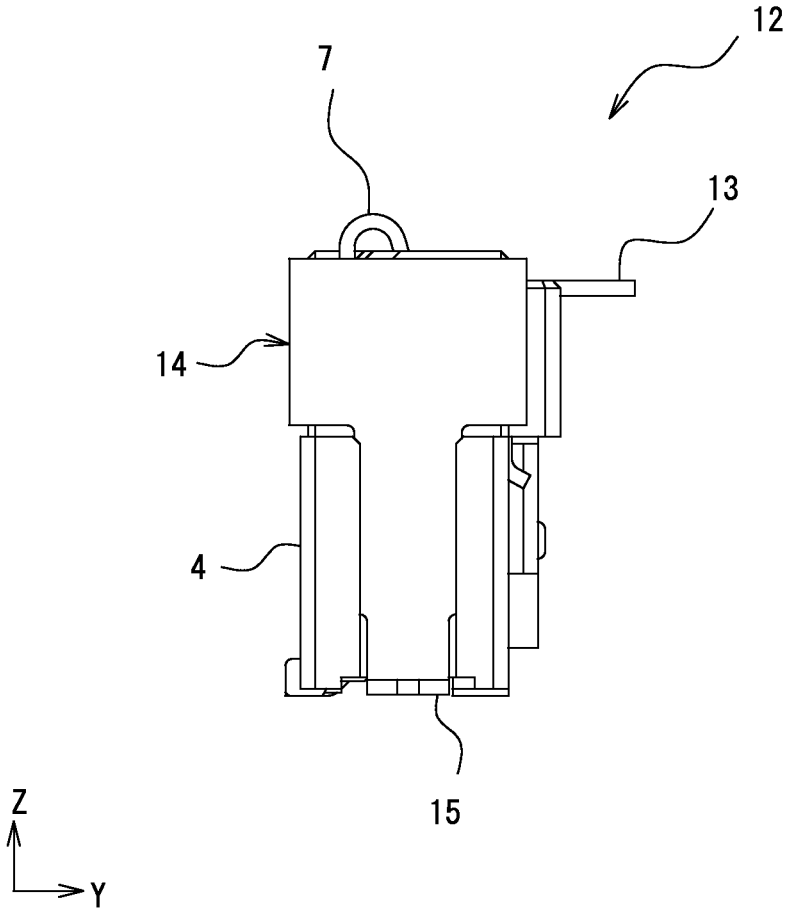
FIG. 20 is a right side view illustrating the connector of FIG. 14.
Figure 21:
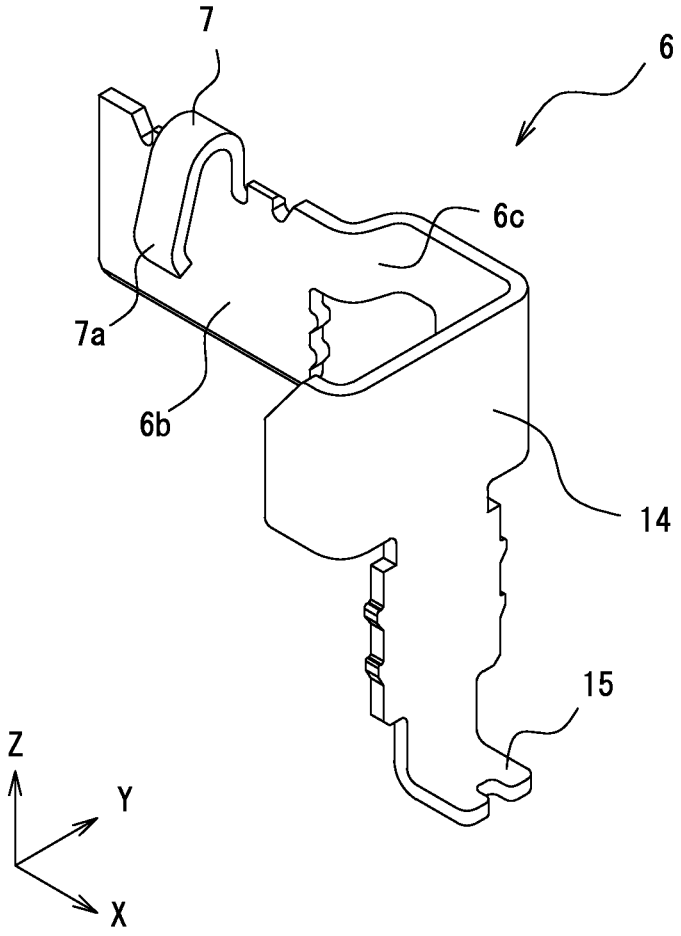
FIG. 21 is a perspective view illustrating a reinforcement member of the second embodiment.
Figure 22:
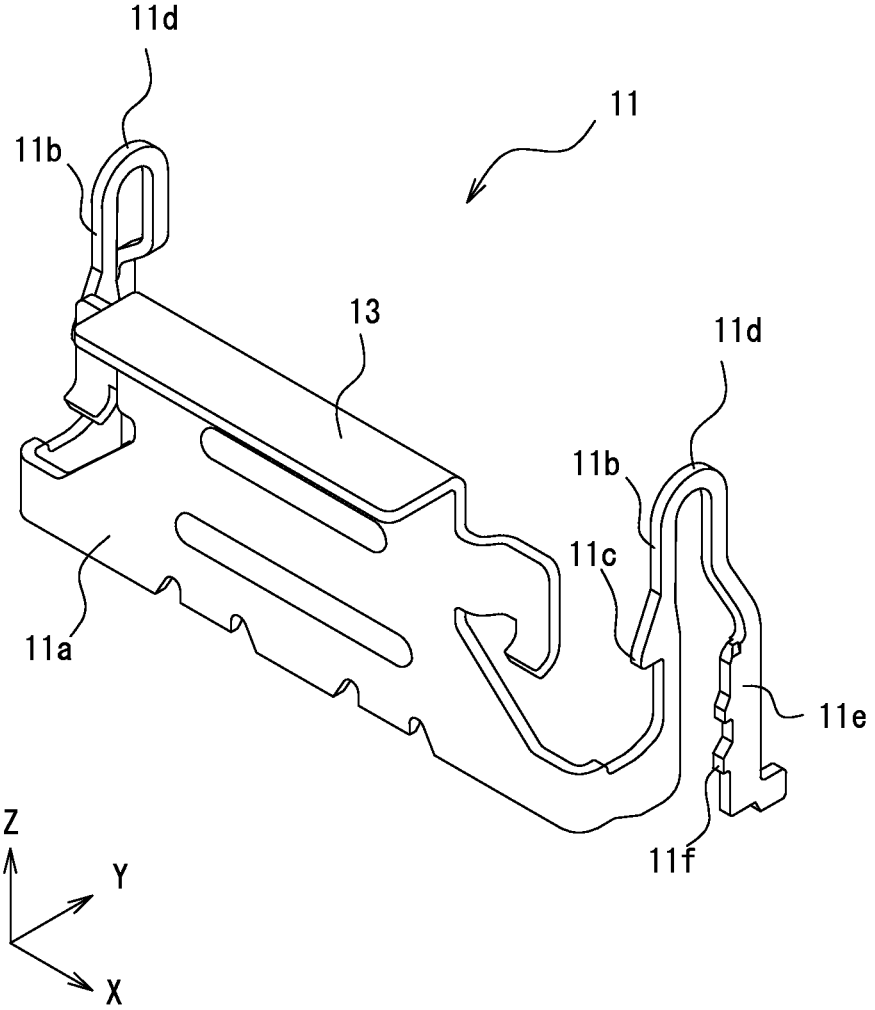
FIG. 22 is a perspective view illustrating an elastic lock piece of the second embodiment.

Furthermore, when disconnecting and removing the flat conductor 3 including a plate from the connector 1, the lock protrusions 11*c* and 11*c* of the elastic lock piece 11 needs to be disconnected from the recesses 10 of the flat conductor 3 including a plate. In order to achieve the above, the operation portion 11*a* is pushed down towards the circuit board 2 side (in the arrow A direction). As described above, by pressing the operation portion 11*a* so that the operation portion 11*a* moves into the recess 4*g* of the housing 4, the lock protrusions 11*c* and 11*c* can be sufficiently displaced towards the circuit board 2 side and the flat conductor 3 including a plate can be disconnected from the recesses 10 and 10. In the above state, the flat conductor 3 including a plate can be pulled out from the connector 1 (FIG. 13).

Now if supposing that the two lock protrusions 11*c* and 11*c* each include an operation portion 11*a* that interlocks with the corresponding lock protrusion 11*c* and that all of the operation portions 11*a* corresponding to the two lock protrusions 11*c* and 11*c* need to be pressed in order to cancel the locked state of the flat conductor 3 including a plate locked with the lock protrusions 11*c* and 11*c*, then, work efficiency will be low and the workload on the operator (not shown) will be large. Conversely, in the present embodiment, the two lock protrusions 11*c* interlock with a single operation portion 11*a*. Accordingly, by pressing the single operation portion 11*a*, the two lock protrusions 11*c* can be displaced in the thickness direction of the flat conductor 3 including a plate and locking with the flat conductor 3 including a plate can be canceled. Accordingly, the operator can perform an operation of canceling the locked state of the flat conductor 3 including a plate with a single action and, accordingly, the operation of canceling the locked state of the flat conductor 3 including a plate with the lock protrusions 11*c* and 11*c* can be performed in a further efficient manner.

Description of the Effects of the Connector 1

The effects of the connector 1 other than those that have been described already will be described next.

Different from the connector 1 of the present embodiment, if the entire housing portion 4*f* were to have a size that is capable of housing the second connection 9 that is formed thicker than the first connection 8, the housing portion 4*f* will become too large in the thickness direction of the flat conductor 3 including a plate and a gap will be created between the first connection 8 and the inner wall of the housing portion 4*f*. With the above, there will be cases in which the connection between the first connection 8 and the terminals 5 becomes unstable; accordingly, work to close the gap by adhering tape to the noncontact side surface of the first connection 8, for example, will be required. Furthermore, when using a flat conductor with only the cable body 3*b* and no ground plate 3*a*, a gap amounting to the ground plate 3*a* will be created not only in the first connection 8 but also in the corresponding portion of the second connection 9; accordingly, a similar measure to fill the gap will be required.

Conversely, in the connector 1 according to the present embodiment, the housing portion 4*f* includes the first space 4*f*1 and the second space 4*f*2. The above can prevent a large gap from being created between the inner wall of the housing portion 4*f* and the first connection 8 by forming the first space 4*f*1 to have a size that allows the first connection 8 to be inserted but does not allow the second connection 9 to be inserted.

Accordingly, as is the case of the flat conductor 3 including a plate, even if the first connection 8 and the second connection 9 on which the ground plate 3*a* is stacked are formed, conductive connection can be made with the connector 1 in a stable manner. In other words, the terminals 5 may be disposed in the first space 4*f*1 and the first connection 8 may be housed in the first space 4*f*1, and the ground terminals 7 may be disposed in the second space 4*f*2 that is formed large in the thickness direction of the flat conductor and the second connection 9 may be disposed in the second space 4*f*2.

Furthermore, with such a configuration, even in the case of a flat conductor (not shown) that is different from the flat conductor 3 including a plate and that has no ground plate 3*a* stacked thereon, the flat conductor can be connected to the connector 1. In such a case, when the flat conductor is inserted into the first space 4*f*1, the terminals 5 press the flat conductor against the top surface portion 4*b* of the housing 4. Furthermore, by having the lock protrusions 11*c* be inserted into and locked to the recesses 10 of the typical flat conductor, fitting is completed. With the above, even in a case of a typical flat conductor, the connector 1 can be conductively connected in a stable manner.

When force is applied to the flat conductor 3 including a plate in the disconnecting and removing direction when the flat conductor 3 including a plate is locked to the connector 1, since the lock protrusions 11*c* of the elastic lock piece 11 are abutted against the edge portions 10*a* of the recesses 10 of the flat conductor 3 including a plate so as to prevent dislocation, the state in which the terminals 5 of the connector 1 and the flat conductor 3 including a plate are in contact with each other is maintained. Accordingly, the flat conductor 3 including a plate can be locked to the connector 1 without the need of providing separate members such as an actuator and a slider; accordingly, the connector 1 can be reduced in size in the height direction Z. Furthermore, since the flat conductor 3 including a plate is not fitted along members with a moving structure such as an actuator and a slider that have the possibility of becoming loose but is fitted along the inner wall surface of the housing portion 4*f* of the housing 4 itself, a reliable fitting state with no unstable factors such as occurrence of looseness can be maintained. Furthermore, since locking can be performed with a single action of inserting the flat conductor 3 including a plate into the connector 1, fitting work is facilitated.

As described above, according to the connector 1 of the present embodiment, a single connector 1 can be used for both connecting a typical flat conductor and the flat conductor 3 including a plate, and connection reliability with the typical flat conductor and with the flat conductor 3 including a plate can be increased.

Accordingly, there are various advantages for the user and the manufacturer, such as reduction in manufacturing cost and elimination of the need to select adapting connectors.

Second Embodiment (FIGS. 14 to 26)

Figure 23:
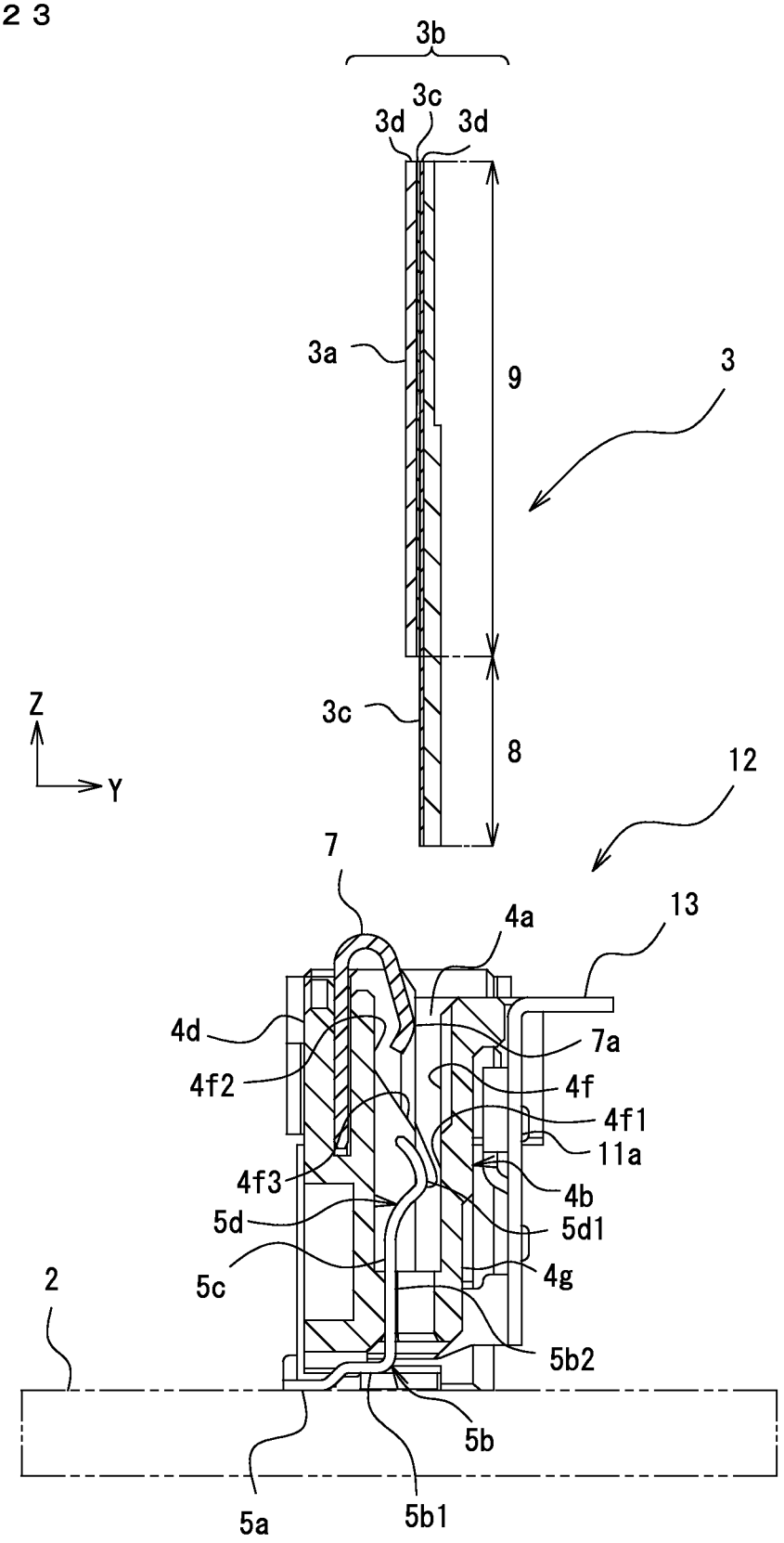
FIG. 23 is an explanatory drawing of a fitting state between the connector of FIG. 14 and the flat conductor.
Figure 24:
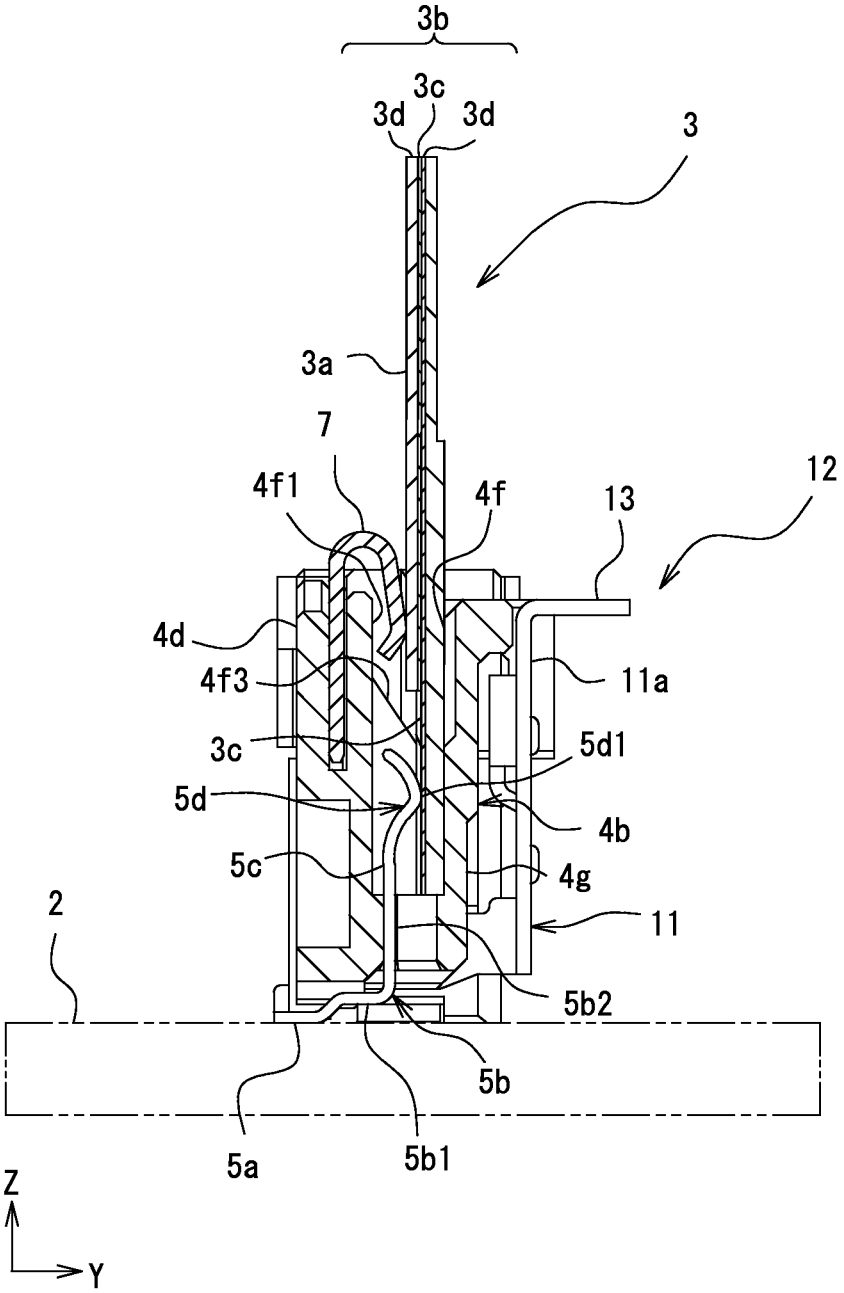
FIG. 24 is an explanatory drawing of a fitting state between the connector of FIG. 14 and the flat conductor.

In the embodiment described above, the connector 1 that is placed flat with respect to the circuit board 2 and in which a so-called angle connection is performed with the flat conductor 3 including a plate has been described. Conversely, in a second embodiment, as illustrated in FIGS. 14 to 26, the connector is a connector 12 that is placed vertically with respect to the circuit board 2 and in which a so-called straight connection is performed with the flat conductor 3 including a plate. In such a case, the flat conductor 3 including a plate is inserted into the housing portion 4*f* through the slot 4*a* in a vertical direction (the Z direction) with respect to the circuit board 2 (FIGS. 23 and 24). Since the mounting area can be reduced with the connector 12, as described above, that is placed vertically with respect to the circuit board 2, the connector 12 can be mounted even in a small space where other components are densely mounted. Furthermore, even if the connector and the slot cannot be easily cited from a direction parallel to the surface of the circuit board 2, it will be possible to insert the flat conductor 3 including a plate.

Note that in the present embodiment, a description will be given while the direction that is parallel to the circuit board 2 and that extends in the longitudinal direction of the connector 12 is referred to as a Y direction, and a direction that extends in the transverse direction of the connector 12 is referred to as an X direction. Furthermore, the description will be given while the height direction of the connector 12 is referred to as a Z direction. Furthermore, the description will be given such that, in a height direction Z of the connector 12, the side on the circuit board 2 is a "lower side" and the side on the connector 12 is an "upper side"; however, the above do not restrict the fitting direction of the connector 12 and the manner in which the connector 12 is mounted on the circuit board 2.

Furthermore, as illustrated in FIGS. 14 to 20, fixed portions 14 of the reinforcement members 6 according to the present embodiment are exposed to the outside through the housing 4. In other words, the fixed portions 14 are fixed to the housing 4 so as to hold the two end sides of the housing 4 in the longitudinal direction Y of the housing 4 from the outside. Furthermore, ground connections 15 with respect to the circuit board 2 are provided at positions that are in contact with the circuit board 2 and at the lower sides of the fixed portions 14 in the height direction Z of the connector 12 and are formed so as to protrude towards the outside of the housing 4. By being protruded towards the outside from the housing 4 in the above manner, the connector 12 for straight connection that is placed vertically with respect to the circuit board 2 and whose fixed state is apt to become unstable with respect to the circuit board 2 can be reliably fixed to the circuit board 2.

In the case of the connector 12 of the present embodiment, if the operation portion 11*a* of the elastic lock piece 11 is, similar to the connector 1 of the first embodiment, provided on the far side with respect to the insertion direction of the flat conductor 3 including a plate (the lower side in the height direction Z in the present embodiment), the operation portion 11*a* becomes close to the circuit board 2 making the press operation difficult to be performed.

Accordingly, in the present embodiment, as illustrated in FIGS. 14 to 26, the operation portion 11*a* is extended towards the slot 4*a* side and a press portion 13 that protrudes in the lateral direction of the housing 4 is provided at a position in the vicinity of the upper side of the slot 4*a* in the height direction Z of the housing 4. The press portion 13 is provided as a tabular piece that extends in the longitudinal direction Y of the housing 4 and, furthermore, since the press portion 13 is parallel to the circuit board 2, when the connector 12 is automatically mounted, the press portion 13 is used as a suction surface for picking up the connector 12 with a suction nozzle.

For example, when the connector 12 is to be mounted on the circuit board where other components are densely mounted, there are cases in which there is no space around the housing 4 to elastically deform the operation portion 11*a*. In such cases, it is difficult to displace the operation portion 11*a* in a direction that is orthogonal to the outer surface of the housing 4 or in a direction that moves away from the outer surface of the housing 4, for example. Conversely, in the present embodiment, the press portion 13 is configured so as to be pushed down from above in the arrow B direction such that the operation portion 11*a* is elastically displaced along the outer surface of the housing 4. With the above, the operation portion 11*a* can be operated even if there is not enough space around the housing 4 to displace the operation portion 11*a* in a direction moving away from the housing 4.

Figure 25:
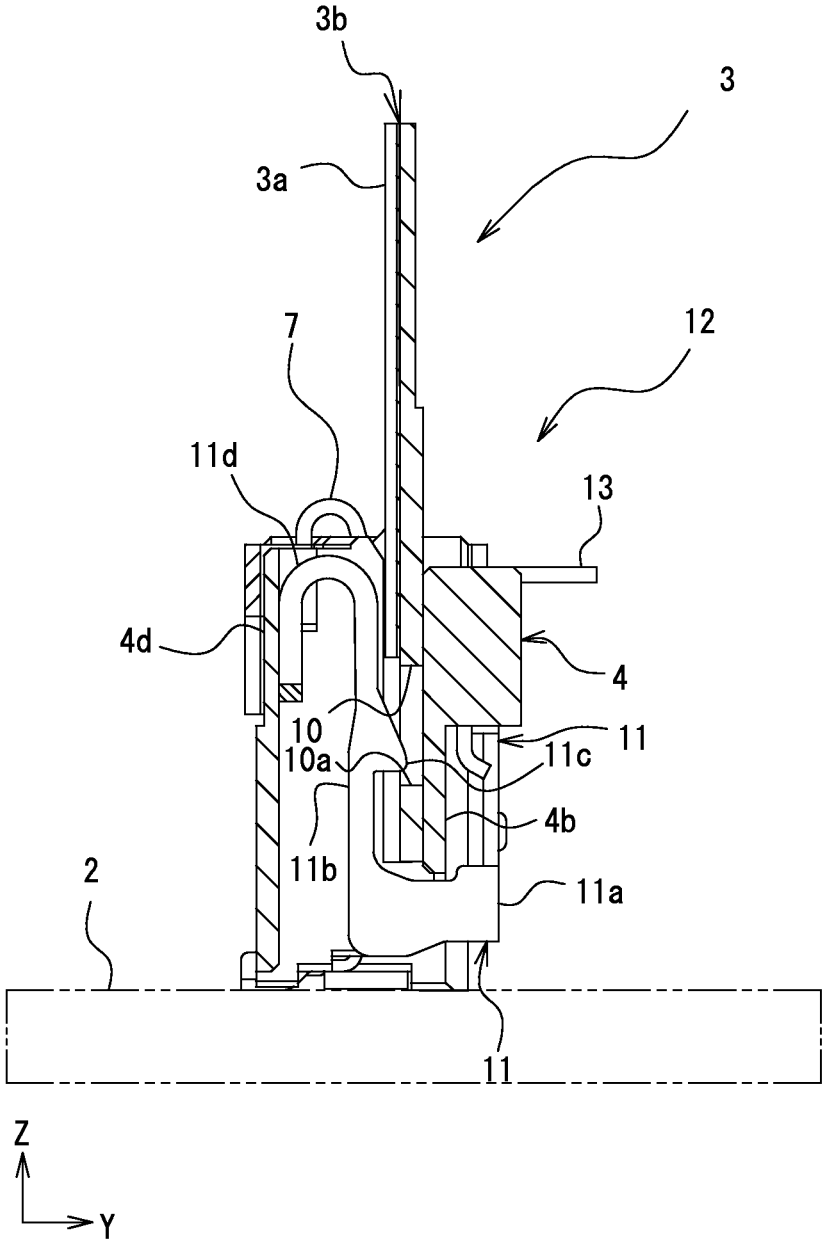
FIG. 25 is an explanatory drawing illustrating a releasing method of the elastic lock piece of the connector of FIG. 14.
Figure 26:
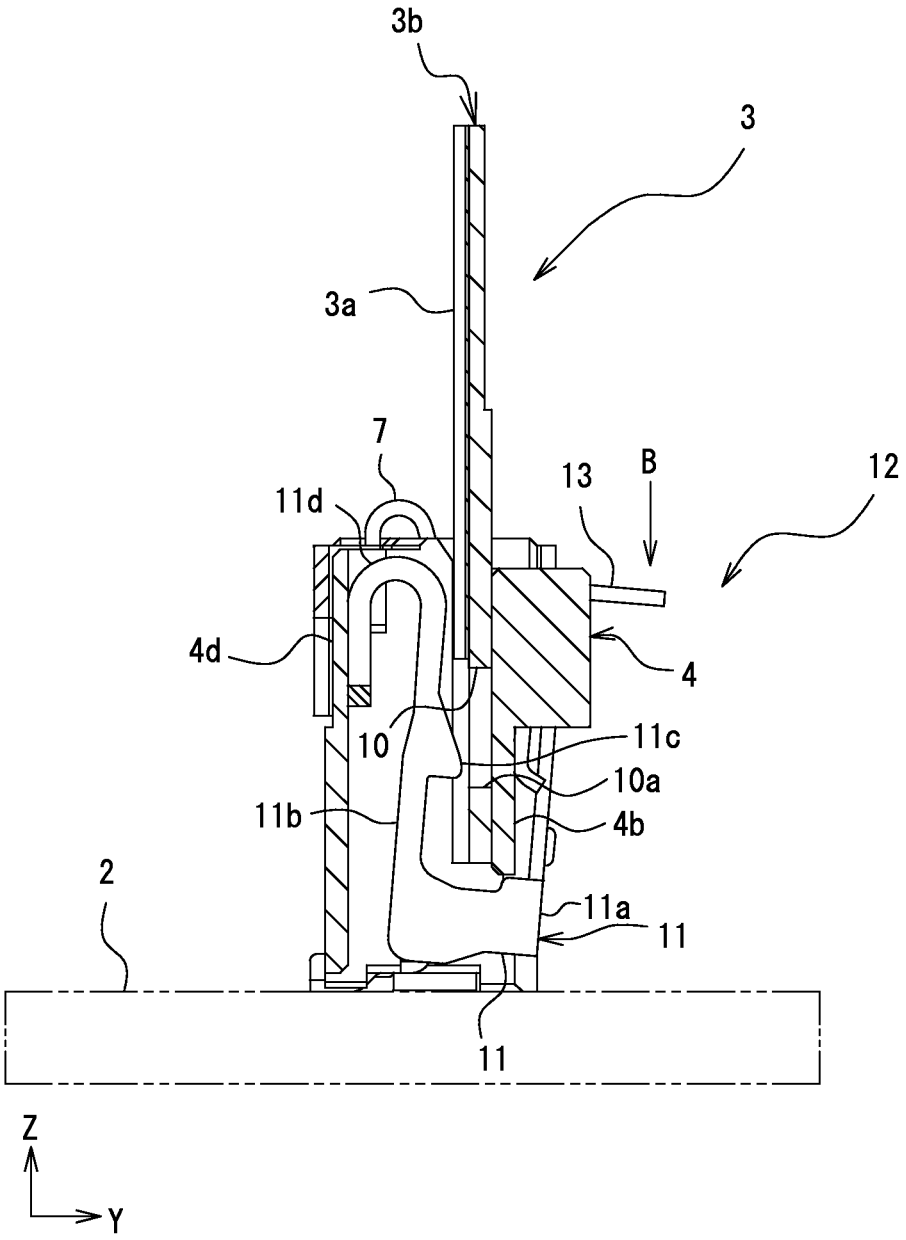
FIG. 26 is an explanatory drawing illustrating a releasing method of the elastic lock piece of the connector of FIG. 14.

By displacing the operation portion 11*a* in the above manner, as illustrated in FIGS. 25 and 26, the elastic lock piece 11 that is fixed by the fixed portions 11*e* pivots about the bent portions 11*d* serving as fulcrums and the operation portion 11*a* and the elastic arms 11*b* are inclined obliquely with respect to the housing 4. In accordance with the above, the lock protrusions 11*c* are displaced so as to move away from the flat conductor 3 including a plate and are dislocated from the recesses 10; accordingly, the locked state is canceled.

Modification of Each of the Embodiments

In each of the embodiments described above, examples have been given in which the reinforcement members 6 and the elastic lock piece 11 are integrally formed with respect each other. Conversely, the reinforcement members 6 and the elastic lock piece 11 may be formed as separate members. Furthermore, the reinforcement members 6 may each be formed of a metal piece and the elastic lock piece 11 may be formed of a resin piece. In such a case, the elastic lock piece 11 may be formed, for example, as a formed body that is integral with the housing 4, which is advantageous in that the number of parts of the elastic lock piece 11 can be reduced.

What is claimed is:

1. A connector, comprising:

a housing that forms a housing portion for a flat conductor, the flat conductor including a first connection on a front side in an insertion direction of a flat conductor body, the flat conductor body provided with a conductive line between flat insulation substrates, and a second connection including a conductive member stacked on one surface of one of the insulation substrates of the flat conductor body such that the second connection is formed with a plate thickness that is greater than that of the first connection; and a connector that includes a first terminal that is retained by the housing and that is connected to the flat conductor, and a second terminal that is retained by the housing and that is connected to the flat conductor, wherein the housing portion includes a first space in which the first terminal is disposed and that is connected to the first connection, and a second space in which the second terminal is disposed and that is connected to the second connection, the second space capable of housing the second connection is formed larger than the first space by a thickness that is equivalent to or greater than the thickness of the conductive member, the housing includes a wall that forms the housing portion and a metal reinforcement member that is fitted along the wall, and the reinforcement member includes a fixed portion which is configured to be soldered to a circuit board, and an outermost surface of the fixed portion is arranged to be co-planar to or depressed from an outer surface of the housing.

2. The connector according to claim 1, wherein the housing includes an elastic lock piece that is locked to the flat conductor, and the elastic lock piece includes a lock protrusion that is locked to the flat conductor, and an operation portion that is exposed to an outside of the housing and that is provided along an outer surface of the housing.

3. The connector according to claim 1, wherein the housing includes an elastic lock piece that is locked to the flat conductor, and the elastic lock piece includes a plurality of lock protrusions that are locked to the flat conductor at positions that are different from each other in a width direction of the flat conductor and a single operation portion that is exposed to an outside of the housing, the single operation portion being pressed so as to displace the plurality of lock protrusions in the thickness direction of the flat conductor so that the locked state with the flat conductor is cancelled.

4. The connector according to claim 1, wherein the second terminal is provided by partially extending the reinforcement member into the second space.

5. The connector according to claim 2, wherein the housing includes a wall that forms the housing portion and a metal reinforcement member that is fitted along the wall.

6. The connector according to claim 3, wherein the housing includes a wall that forms the housing portion and a metal reinforcement member that is fitted along the wall.

7. The connector according to claim 2, wherein the flat conductor includes an edge portion that extends in a width direction of the flat conductor, and the elastic lock piece is locked to the edge portion.

8. The connector according to claim 2, wherein the elastic lock piece includes an elastic arm that extends towards an inside of the housing from the operation portion and that is elastically displaced in the thickness direction of the flat conductor when a press operation is performed on the operation portion, the lock protrusion being provided in the elastic arm and being capable of being attached to and detached from the flat conductor when the elastic arm is elastically displaced.

9. The connector according to claim 2, wherein the operation portion is provided so as to oppose the outer surface of the housing and a recess into which the operation portion is elastically displaced is provided in the outer surface of the housing.

10. The connector according to claim 2, wherein the operation portion elastically displaces along the outer surface of the housing.

11. The connector according to claim 3, wherein the flat conductor includes an edge portion that extends in the width direction of the flat conductor, and the elastic lock piece is locked to the edge portion.

12. The connector according to claim 3, wherein the elastic lock piece includes an elastic arm that extends towards an inside of the housing from the operation portion and that is elastically displaced in the thickness direction of the flat conductor when a press operation is performed on the operation portion, the lock protrusion being provided in the elastic arm and being capable of being attached to and detached from the flat conductor when the elastic arm is elastically displaced.

13. The connector according to claim 3, wherein the operation portion is provided so as to oppose the outer surface of the housing and a recess into which the operation portion is elastically displaced is provided in the outer surface of the housing.

14. The connector according to claim 3, wherein the operation portion elastically displaces along the outer surface of the housing.

15. The connector according to claim 1, wherein the connector is mounted on a circuit board and the insertion direction is parallel with respect to a surface of the circuit board.

16. The connector according to claim 1, wherein the connector is mounted on a circuit board and the insertion direction is orthogonal with respect to a surface of the circuit board.

* * * * *